US007651084B2

(12) United States Patent
Kobayashi

(10) Patent No.: US 7,651,084 B2
(45) Date of Patent: Jan. 26, 2010

(54) FEEDING DEVICE, RECORDING APPARATUS, AND FEEDING METHOD

(75) Inventor: Satoshi Kobayashi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/172,855

(22) Filed: Jul. 14, 2008

(65) Prior Publication Data

US 2009/0014944 A1 Jan. 15, 2009

(30) Foreign Application Priority Data

Jul. 13, 2007 (JP) ..... 2007-184430

(51) Int. Cl.
*B65H 1/26* (2006.01)

(52) U.S. Cl. ..... 271/127; 271/118

(58) Field of Classification Search ..... 271/117, 271/118, 121, 126, 127
See application file for complete search history.

(56) References Cited

U.S. PATENT DOCUMENTS 5,249,787 A * 10/1993 Ifkovits ..... 271/6
5,895,038 A * 4/1999 Takashima ..... 271/114
7,481,423 B2 * 1/2009 Lim et al. ..... 271/118
7,513,496 B2 * 4/2009 Hattori ..... 271/127
2003/0230844 A1 * 12/2003 Shimoyama ..... 271/127
2007/0001376 A1 * 1/2007 Lim et al. ..... 271/121

FOREIGN PATENT DOCUMENTS

| | | |
|---|---|---|
| JP | 09-208064 | 1/1997 |
| JP | 11-180568 | 7/1999 |
| JP | 11-236134 | 8/1999 |
| JP | 2001-026326 | 1/2001 |
| JP | 2006-306616 | 11/2006 |

* cited by examiner

*Primary Examiner*—Kaitlin S Joerger
(74) *Attorney, Agent, or Firm*—Workman Nydegger

(57) ABSTRACT

A feeding device is provided including a stacking portion on which a plurality of recording media are stacked, a feed roller that feeds the recording medium stacked on the stacking portion, biasing means for applying biasing force to either the stacking portion or the feed roller to thereby decrease the distance between the stacking portion and the feed roller, and biasing force adjustment means for adjusting the magnitude of the biasing force of the biasing means.

9 Claims, 26 Drawing Sheets

| | | | | | |
|---|---|---|---|---|---|
| |  |  |  |  |  |
| CAM POSITION | RESET | 10° | 20° | 30° | 40° |
| HOPPER FORCE [N] | 2. 885 | 2. 994 | 3. 099 | 3. 201 | 3. 298 |
| SPRING MOMENT [N · mm] | 82. 377 | 85. 467 | 88. 487 | 91. 377 | 94. 168 |
| CAM SHAFT LOAD T [N · mm] | 34. 167 | 35. 448 | 36. 701 | 37. 900 | 39. 057 |
| LEVER SHAFT LOAD T [N · mm] | 20. 092 | 34. 416 | 36. 328 | 38. 032 | 16. 312 |
| TOTAL CAM SHAFT LOAD T [N · mm] | 54. 259 | 69. 865 | 73. 029 | 75. 932 | 55. 370 |
| MOTOR SHAFT TORQUE [N · mm] | 4. 927 | 6. 344 | 6. 631 | 6. 895 | 5. 028 |
| |  |  |  |  |  |
| CAM POSITION | 50° | 60° | 70° | 80° | 90° |
| HOPPER FORCE [N] | 1. 721 | 1. 798 | 1. 862 | 1. 903 | 1. 915 |
| SPRING MOMENT [N · mm] | 49. 147 | 51. 340 | 53. 164 | 54. 340 | 54. 659 |
| CAM SHAFT LOAD T [N · mm] | 0. 000 | 0. 000 | 0. 000 | 0. 000 | 0. 000 |
| LEVER SHAFT LOAD T [N · mm] | 20. 330 | 20. 555 | 19. 887 | 17. 756 | 14. 502 |
| TOTAL CAM SHAFT LOAD T [N · mm] | 20. 330 | 20. 555 | 19. 887 | 17. 756 | 14. 502 |
| MOTOR SHAFT TORQUE [N · mm] | 1. 846 | 1. 866 | 1. 806 | 1. 612 | 1. 317 |

| | | | | | |
|---|---|---|---|---|---|
| |  | | | | |
| CAM POSITION | 100 TO 230° | 240° | 250° | 260° | 270° |
| HOPPER FORCE [N] | 1. 915 | 1. 915 | 1. 908 | 1. 886 | 1. 259 |
| SPRING MOMENT [N · mm] | 54. 659 | 54. 659 | 54. 470 | 53. 852 | 35. 951 |
| CAM SHAFT LOAD T [N · mm] | 0. 000 | 0. 000 | 0. 000 | 0. 000 | 0. 000 |
| LEVER SHAFT LOAD T [N · mm] | 14. 506 | 14. 420 | 12. 440 | 9. 891 | 4. 797 |
| TOTAL CAM SHAFT LOAD T [N · mm] | 14. 506 | 14. 420 | 12. 440 | 9. 891 | 4. 797 |
| MOTOR SHAFT TORQUE [N · mm] | 1. 317 | 1. 309 | 1. 130 | 0. 898 | 0. 436 |
| |  | | | | |
| CAM POSITION | 280° | 290° | 300° | 310° | 320° |
| HOPPER FORCE [N] | 1. 373 | 1. 728 | 2. 097 | 2. 441 | 2. 673 |
| SPRING MOMENT [N · mm] | 39. 190 | 49. 347 | 59. 862 | 69. 679 | 76. 317 |
| CAM SHAFT LOAD T [N · mm] | 42. 892 | 50. 841 | 65. 342 | 75. 053 | 65. 852 |
| LEVER SHAFT LOAD T [N · mm] | 3. 175 | 1. 509 | −0. 747 | −3. 051 | −4. 733 |
| TOTAL CAM SHAFT LOAD T [N · mm] | 46. 067 | 52. 350 | 64. 596 | 72. 002 | 61. 119 |
| MOTOR SHAFT TORQUE [N · mm] | 4. 183 | 4. 753 | 5. 865 | 6. 538 | 5. 550 |

| | | | | | |
|---|---|---|---|---|---|
| |  |  |  |  |  |
| CAM POSITION | 330° | 340° | 350° | 360° | RESET |
| HOPPER FORCE [N] | 2. 850 | 2. 845 | 2. 743 | 2. 787 | 2. 885 |
| SPRING MOMENT [N·mm] | 81. 361 | 81. 221 | 78. 311 | 79. 567 | 82. 377 |
| CAM SHAFT LOAD T [N·mm] | 72. 674 | 68. 728 | 43. 440 | −8. 201 | 34. 167 |
| LEVER SHAFT LOAD T [N·mm] | −5. 477 | −4. 997 | −3. 456 | −1. 757 | 20. 092 |
| TOTAL CAM SHAFT LOAD T [N·mm] | 67. 197 | 63. 731 | 39. 984 | −9. 957 | 54. 259 |
| MOTOR SHAFT TORQUE [N·mm] | 6. 101 | 5. 787 | 3. 631 | −0. 904 | 4. 927 |

| |  |  |  |  |  |
|---|---|---|---|---|---|
| CAM POSITION | RESET | 10° | 20° | 30° | 40° |
| HOPPER FORCE [N] | 2. 286 | 2. 425 | 2. 565 | 2. 704 | 2. 840 |
| SPRING MOMENT [N · mm] | 65. 274 | 69. 241 | 73. 238 | 77. 204 | 81. 082 |
| CAM SHAFT LOAD T [N · mm] | 27. 159 | 28. 810 | 30. 473 | 32. 123 | 33. 737 |
| LEVER SHAFT LOAD T [N · mm] | 29. 171 | 31. 821 | 34. 587 | 37. 442 | 16. 800 |
| TOTAL CAM SHAFT LOAD T [N · mm] | 56. 330 | 60. 631 | 65. 059 | 69. 565 | 50. 536 |
| MOTOR SHAFT TORQUE [N · mm] | 5. 115 | 5. 505 | 5. 907 | 6. 317 | 4. 589 |
| |  |  |  |  |  |
| CAM POSITION | 50° | 60° | 70° | 80° | 90° |
| HOPPER FORCE [N] | 1. 318 | 1. 446 | 1. 585 | 1. 710 | 1. 824 |
| SPRING MOMENT [N · mm] | 37. 625 | 41. 293 | 45. 250 | 48. 808 | 52. 078 |
| CAM SHAFT LOAD T [N · mm] | 0. 000 | 0. 000 | 0. 000 | 0. 000 | 0. 000 |
| LEVER SHAFT LOAD T [N · mm] | 19. 234 | 21. 682 | 24. 353 | 26. 870 | 29. 068 |
| TOTAL CAM SHAFT LOAD T [N · mm] | 19. 234 | 21. 682 | 24. 353 | 26. 870 | 29. 068 |
| MOTOR SHAFT TORQUE [N · mm] | 1. 746 | 1. 969 | 2. 211 | 2. 440 | 2. 639 |

| | | | | | |
|---|---|---|---|---|---|
| |  |  |  |  |  |
| CAM POSITION | 100 TO 230° | 240° | 250° | 260° | 270° |
| HOPPER FORCE [N] | 1. 990 | 1. 964 | 1. 759 | 1. 241 | 0. 716 |
| SPRING MOMENT [N · mm] | 56. 812 | 56. 064 | 50. 234 | 35. 443 | 20. 432 |
| CAM SHAFT LOAD T [N · mm] | 0. 000 | 0. 000 | 0. 000 | 0. 000 | 0. 000 |
| LEVER SHAFT LOAD T [N · mm] | 25. 001 | 13. 718 | −29. 947 | −66. 783 | 1. 429 |
| TOTAL CAM SHAFT LOAD T [N · mm] | 25. 001 | 13. 718 | −29. 947 | −66. 783 | 1. 429 |
| MOTOR SHAFT TORQUE [N · mm] | 2. 270 | 1. 246 | −2. 719 | −6. 064 | 0. 130 |
| |  |  |  |  |  |
| CAM POSITION | 280° | 290° | 300° | 310° | 320° |
| HOPPER FORCE [N] | 0. 834 | 1. 173 | 1. 593 | 1. 915 | 2. 132 |
| SPRING MOMENT [N · mm] | 23. 821 | 33. 489 | 45. 469 | 54. 659 | 60. 878 |
| CAM SHAFT LOAD T [N · mm] | 26. 195 | 37. 400 | 52. 632 | 54. 167 | 54. 796 |
| LEVER SHAFT LOAD T [N · mm] | 1. 666 | 2. 342 | 3. 180 | 3. 822 | 4. 257 |
| TOTAL CAM SHAFT LOAD T [N · mm] | 27. 861 | 39. 742 | 55. 812 | 57. 989 | 59. 053 |
| MOTOR SHAFT TORQUE [N · mm] | 2. 530 | 3. 609 | 5. 068 | 5. 265 | 5. 362 |

| | | | | | |
|---|---|---|---|---|---|
| |  | | | | |
| CAM POSITION | 330° | 340° | 350° | 360° | RESET |
| HOPPER FORCE [N] | 2. 311 | 2. 472 | 2. 553 | 2. 477 | 2. 286 |
| SPRING MOMENT [N · mm] | 65. 972 | 70. 576 | 72. 899 | 70. 726 | 65. 274 |
| CAM SHAFT LOAD T [N · mm] | 62. 172 | 63. 437 | 40. 409 | −7. 735 | 27. 159 |
| LEVER SHAFT LOAD T [N · mm] | 4. 614 | 4. 936 | 1. 309 | −3. 980 | 29. 171 |
| TOTAL CAM SHAFT LOAD T [N · mm] | 66. 786 | 68. 373 | 41. 719 | −11. 714 | 56. 330 |
| MOTOR SHAFT TORQUE [N · mm] | 6. 064 | 6. 208 | 3. 788 | −1. 064 | 5. 115 |

FIG. 22A
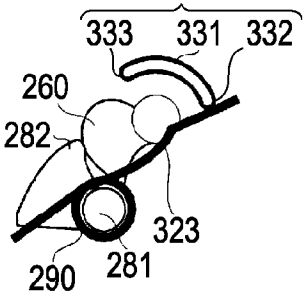
FIG. 22B
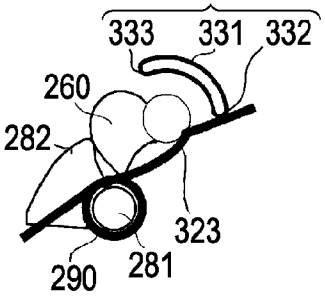
FIG. 22C
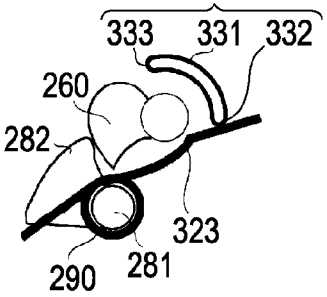
FIG. 22D
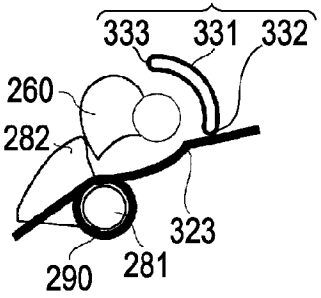
FIG. 22E
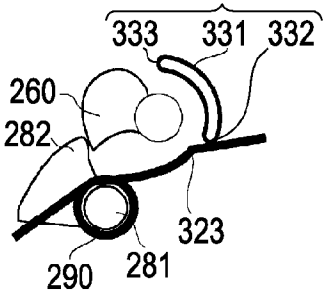
FIG. 22F
FIG. 22G
FIG. 22H
FIG. 22I
FIG. 22J
FIG. 22K
FIG. 22L
FIG. 22M
FIG. 22N
FIG. 22O

FEEDING DEVICE, RECORDING APPARATUS, AND FEEDING METHOD

BACKGROUND

1. Technical Field

The present invention relates to a feeding device that includes a stacking portion on which a plurality of recording media are stacked, a feed roller that feeds the recording medium stacked on the stacking portion, and biasing means for applying biasing force to either the stacking portion or the feed roller to thereby decrease the distance between the stacking portion and the feed roller. The present invention also relates to a recording apparatus having the feeding device and a feeding method for use in the feeding device.

In the present invention, examples of the recording apparatus include an ink jet printer, a wire dot printer, a laser printer, a line printer, a copying machine, and a facsimile machine.

A liquid ejecting apparatus used herein is not limited to an ink jet recording apparatus, a copying machine, and a facsimile machine, which record data or images by ejecting ink onto a recording medium such as recording paper from a recording head as a liquid ejecting head. Other examples of the liquid ejecting apparatus include an apparatus that attaches liquid for a specific application, instead of ink, to an ejecting target medium corresponding to the recording medium by ejecting the liquid to the ejecting target medium from a liquid ejecting head corresponding to the recording head.

Examples of the liquid ejecting head include, in addition to the above-described recording head, a color-material ejecting head used in production of a color filter for a liquid crystal display or other apparatuses, an electrode-material (conductive paste) ejecting head used in formation of an electrode for an organic EL display, a field emission display (FED), or other apparatuses, a bioorganic-substance ejecting head used in production of a biochip, and a sample ejecting head as a precision pipette.

2. Related Art

In the past, for example, JP-A-2006-306616 discloses a feeding device installed in a recording apparatus includes a feed roller and a hopper configured to be movable toward and away from the feed roller. The hopper is biased toward the feed roller by a hopper lever. Specifically, one end of a torsion coil spring engages with the hopper lever, and the other end is fixed to a base portion of the feeding device. The torsion coil spring applies a biasing force to the hopper via the hopper lever.

FIG. 26 is a side sectional view illustrating an outline of the feeding device according to the related art.

As shown in FIG. 26, the feeding device 400 of the related art includes a base portion 411, a feed roller 401, a hopper 402, and a hopper lever 403. The hopper lever 403 is integrally formed with a cam follower 405 and is pivotable about a lever shaft 404. A first arm portion 407 of the torsion coil spring 406 engages with the hopper lever 403, and a second arm portion 408 engages with a spring fixing and engagement portion 413 of the base portion 411.

A hopper cam 409 configured to engage with the cam follower 405 is formed in a cam shaft 410. The hopper cam 409 is configured to be pivotable in the counter-clockwise direction in the drawing by the driving power of a feed motor (not shown). When the hopper cam 409 engages with the cam follower 405, the hopper lever 403 is pivoted in the clockwise direction in the drawing while resisting the biasing force of the torsion coil spring 406. At this time, the hopper 402 and the hopper lever 403 are integrally moved away from the feed roller 401. That is, a so-called hopper-down operation is carried out.

When the hopper cam 409 is pivoted further in the counter-clockwise direction, the hopper cam 409 is disengaged with the cam follower 405. Therefore, the hopper lever 403 is pivoted in the counter-clockwise direction by the biasing force of the torsion coil spring 406. At this time, the hopper lever 403 causes the hopper 402 to be moved toward the feed roller 401. That is, a so-called hopper-up operation is carried out. The sheet stacked on the hopper 402 is picked up by the feed roller 401 that rotates in the clockwise direction.

At the same time, feeding force is produced by the force that biases the sheet against the feed roller 401. Therefore, the sheet is fed out while being guided by a guide surface portion 412.

When the feeding operation is completed, the hopper cam 409 pivoted in the clockwise direction engages again with the cam follower 405, whereby the hopper-down operation is carried out.

However, the second arm portion 408 of the torsion coil spring 406 is fixed at the spring fixing and engagement portion 413 of the base portion 411. That is, the magnitude of the biasing force of the torsion coil spring 406 is not adjustable. However, a required sheet feeding force may vary in the course of the feeding operation. That is, there may be a case in which the sheet is fed by an excessive feeding force greater than a required force. In such a case, the energy is uselessly lost.

As another example, there may be a case in which the biasing force is unnecessarily large even when the sheet feeding operation is completed or before the feeding operation is started. In such a case, the energy loss is considerable.

SUMMARY

An advantage of some aspects of the invention is that it provides a feeding device and a recording apparatus having the feeding device, capable of reducing the energy loss in the biasing force of the biasing means.

According to a first aspect of the invention, there is provided a feeding device that includes a stacking portion on which a plurality of recording media are stacked; a feed roller that feeds the recording medium stacked on the stacking portion; biasing means for applying biasing force to either the stacking portion or the feed roller to thereby decrease the distance between the stacking portion and the feed roller; and biasing force adjustment means for adjusting the magnitude of the biasing force of the biasing means.

According to the first aspect of the invention, the feeding device has the biasing force adjustment means. Therefore, it is possible to adjust the magnitude of the biasing force of the biasing means. As a result, it is possible to reduce the energy loss compared with the prior feeding device.

For example, by adjusting the magnitude of the biasing force, it is possible to adjust the feeding force of the feed roller when feeding the recording medium. Moreover, by decreasing the biasing force when it is desired to increase the distance between the stacking portion and the feed roller, it is possible to facilitate the displacement. Furthermore, when it is desired to decrease the distance, by increasing the biasing force after the distance is decreased, it is possible to reduce the collision noise, which is produced when the distance is decreased.

A second aspect of the invention is the feeding device according to the first aspect, in which the biasing force adjustment means has a cam portion, the biasing means has a torsion coil spring, either the stacking portion or the feed roller is biased against one end of the torsion coil spring, and the other end of the torsion coil spring engages with the cam portion.

According to the second aspect of the invention, in addition to the same operational advantages as in the first aspect, the biasing force adjustment means may have a cam portion, the biasing means may have a torsion coil spring, either the stacking portion or the feed roller may be biased against one end of the torsion coil spring, and the other end of the torsion coil spring may engage with the cam portion. Therefore, it is possible to efficiently configure the biasing force adjustment means.

A third aspect of the invention is the feeding device according to the first or second aspect, in which the feeding device includes displacing means for increasing the distance, and the biasing force adjustment means starts decreasing the biasing force before the distance is increased.

According to the third aspect of the invention, in addition to the same operational advantages as in the first or second aspect, the feeding device may include displacing means for increasing the distance, and the biasing force adjustment means may start decreasing the biasing force before the distance is increased. Therefore, it is possible to decrease the peak load value when increasing the distance while resisting the biasing force compared with the case where the biasing force is not decreased.

For example, when the distance is increased by means of the driving power of a motor or the like, it is possible to decrease the peak torque value of the motor or the like.

A fourth aspect of the invention is the feeding device according to any one of the first to third aspects, in which the feeding device includes displacing means for increasing the distance, and the biasing force adjustment means adjusts the biasing force to the minimum value when the distance is increased by the displacing means.

The term "the minimum value" as used herein refers to the minimum value of the biasing force within an adjustable range.

According to the fourth aspect of the invention, in addition to the same operational advantages as in any one of the first to third aspects, the feeding device may include displacing means for increasing the distance, and the biasing force adjustment means may adjust the biasing force to the minimum value when the distance is increased by the displacing means. Therefore, it is possible to decrease the collision noise, which is produced when the stacked recording medium collides with the feed roller when decreasing the distance from the increased state, compared with the case where the biasing force is not adjusted to the minimum value.

In the above aspect, it is possible to decrease the load applied to other components or elements in the state where the distance is increased compared with the case where the biasing force is not adjusted to the minimum value. Therefore, it is possible to decrease the possibility of the creep deformation in other components or elements.

A fifth aspect of the invention is the feeding device according to any one of the first to fourth aspects, in which the feeding device includes a separation portion capable of separating overlapped recording media which are fed on the downstream side in a feeding direction of the feed roller, and the biasing force adjustment means increases the biasing force after the distance is decreased and until a leading end of a recording medium being fed passes through the separation portion.

According to the fifth aspect of the invention, in addition to the same operational advantages as in any one of the first to fourth aspects, the biasing force adjustment means may increase the biasing force after the distance is decreased and until a leading end of a recording medium being fed passes through the separation portion. Therefore, according to the above aspect, the feed roller can cause the uppermost recording medium to pass through the separation portion. That is, according to the above aspect, it is possible to ensure a stable separation in the separation portion.

A sixth aspect of the invention is the feeding device according to the fifth aspect, in which the feeding device includes a transport roller pair that transports the recording medium fed on the downstream side in the feeding direction of the separation portion toward the downstream side, and the biasing force adjustment means decreases the biasing force after the leading end of the recording medium being fed is passed through the separation portion and immediately before the leading end reaches the transport roller pair.

According to the sixth aspect of the invention, in addition to the same operational advantages as in the fifth aspect, the feeding device may include a transport roller pair that transports the recording medium fed on the downstream side in the feeding direction of the separation portion toward the downstream side, and the biasing force adjustment means may decrease the biasing force after the leading end of the recording medium being fed is passed through the separation portion and immediately before the leading end reaches the transport roller pair. Here, after the leading end of the recording medium is passed through the separation portion, the feeding force is not required to be large enough to allow the recording medium to pass through the separation portion. Therefore, according to the above aspect, it is possible to reduce the energy loss in the feeding force.

A seventh aspect of the invention is the feeding device according to the sixth aspect, in which the biasing force adjustment means increases the biasing force after the leading end of the recording medium being fed is reached to the transport roller pair and until a skew removing operation is completed.

According to the seventh aspect of the invention, in addition to the same operational advantages as in the sixth aspect, the biasing force adjustment means may increase the biasing force after the leading end of the recording medium being fed is reached to the transport roller pair and until a skew removing operation is completed. Therefore, according to the above aspect, the recording medium being fed can be easily deformed between the feed roller and the transport roller pair when the skew removing operation is being performed. As a result, according to the above aspect, it is possible to perform the skew removing operation with high precision.

According to an eighth aspect of the invention, there is provided a recording apparatus which includes a feeding unit that feeds a plurality of recording media stored in stack; and a recording unit that performs a recording on the recording medium fed from the feeding unit by means of a recording head, in which the feeding unit includes the feeding device according to any one of the first to seventh aspects.

According to the eighth aspect of the invention, the feeding unit may include the feeding device according to any one of the first to seventh aspects. Therefore, the recording apparatus can provide the same operational advantages as in any one of the first to seventh aspects.

According to a ninth aspect of the invention, there is provided a feeding method that includes biasing either a stacking portion on which a plurality of recording media are stacked or a feed roller that feeds the recording medium stacked on the stacking portion against one end of a torsion coil spring to thereby decreasing the distance between the stacking portion and the feed roller; and displacing the other end of the torsion coil spring to thereby feed the recording medium.

According to the ninth aspect of the invention, it is possible to provide the same operational advantages as in the first aspect.

BRIEF DESCRIPTION OF THE DRAWINGS

The invention will be described with reference to the accompanying drawings, wherein like numbers reference like elements.

FIGS. 22A to 22O are diagrams illustrating the operation of a biasing force adjustment cam according to a third modified embodiment (at phase angles ranging from 0 to 270 degrees).

DESCRIPTION OF EXEMPLARY EMBODIMENTS

Hereinafter, exemplary embodiments of the invention will be described with reference to the accompanying drawings.

Figure 1:
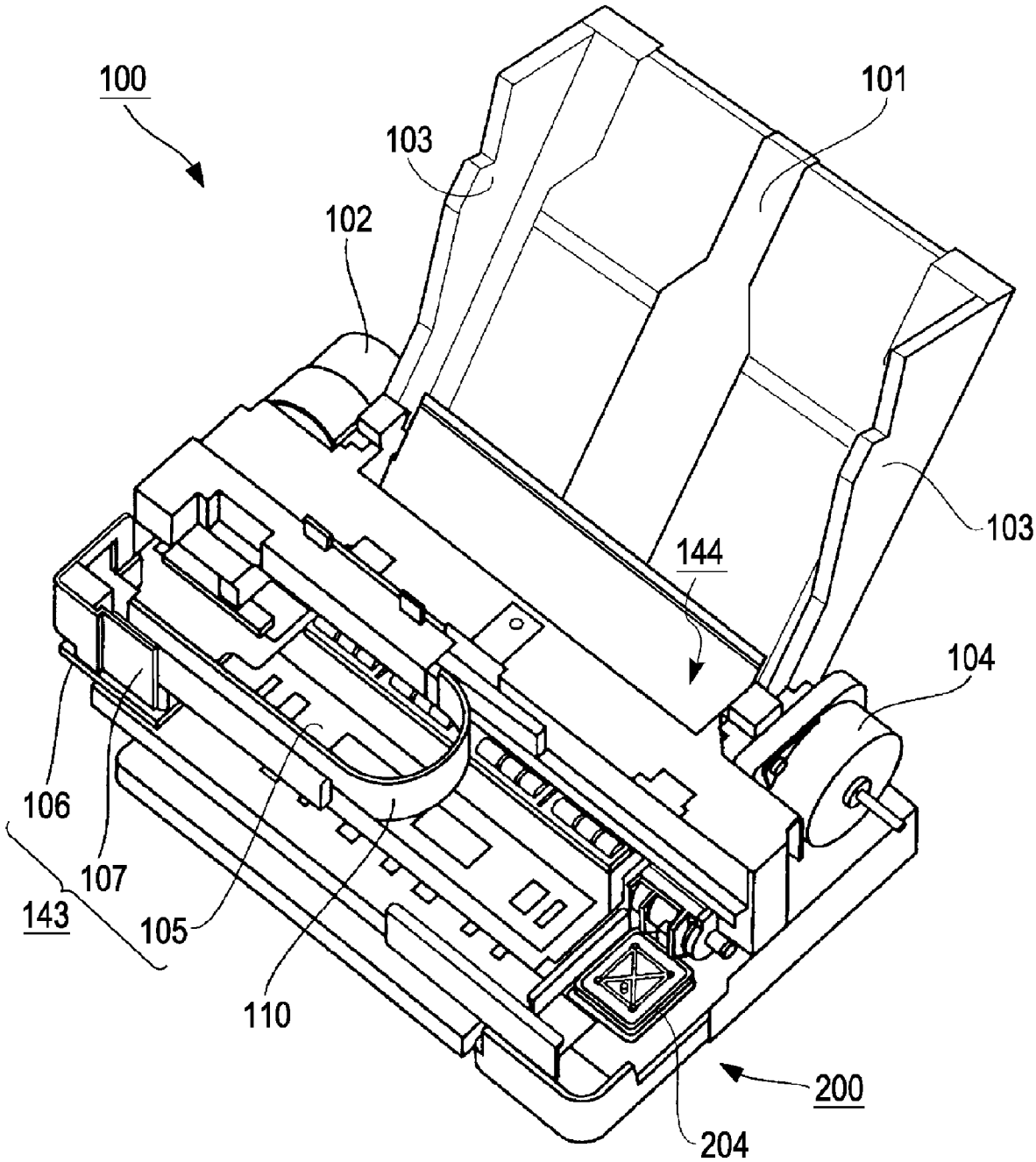
FIG. 1 is a general perspective view illustrating an outline of a recording apparatus according to an embodiment of the invention.
Figure 2:
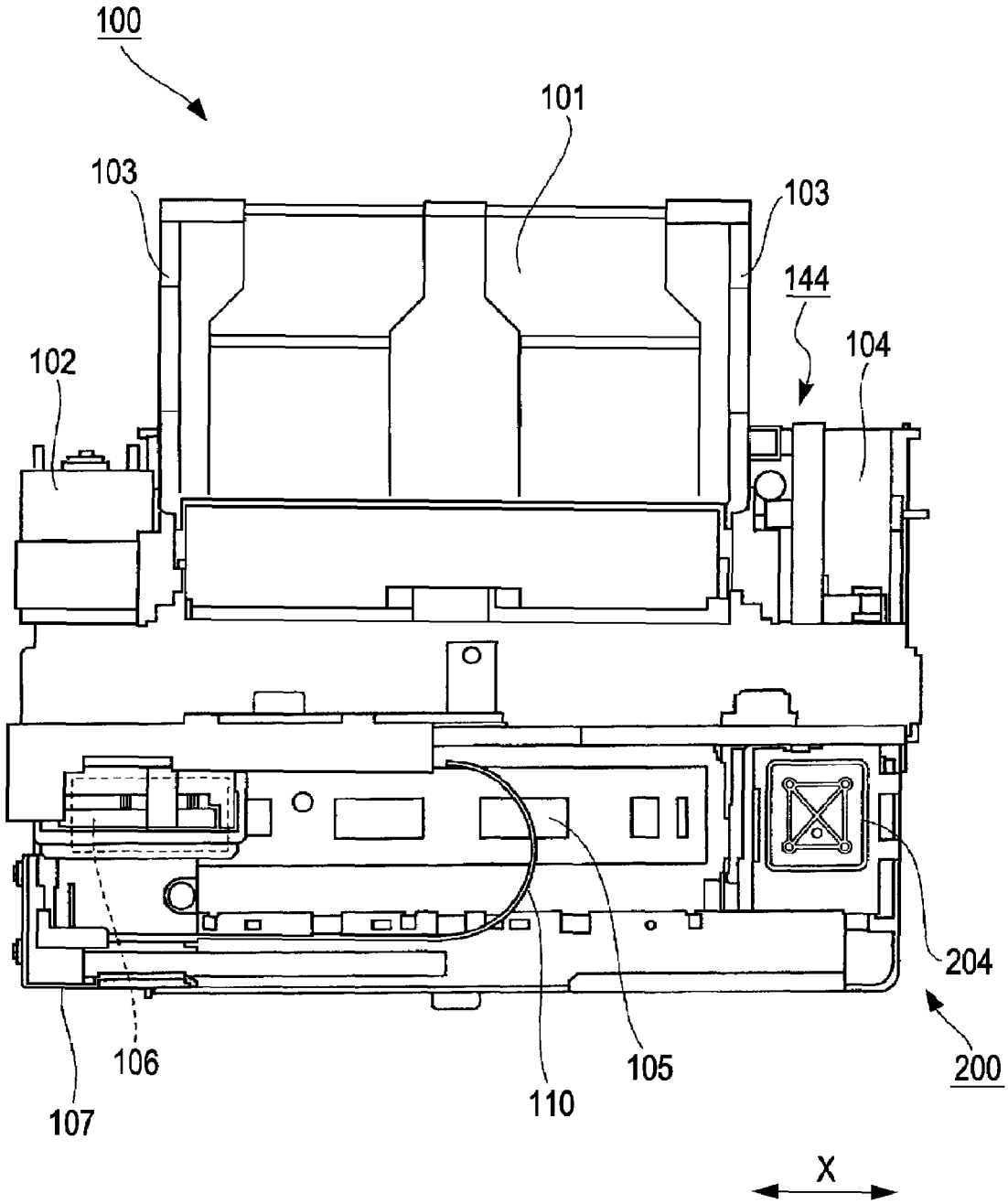
FIG. 2 is a general plan view illustrating an outline of the recording apparatus according to the embodiment.

FIG. 1 is a general perspective view illustrating an outline of a recording apparatus as an example of a liquid ejecting apparatus according to an embodiment of the invention. FIG. 2 is a general plan view illustrating an outline of the recording apparatus according to the embodiment.

On the rear side of a main body of a recording apparatus 100, a hopper 101 as the stacking portion, on which a plurality of sheets P as the recording medium are placed (stacked), is provided pivotable about a pivot point at an upper portion. The uppermost one of the sheets P stacked on the hopper 101 is fed toward a recording unit at the downstream side in the transport direction by a feeding unit 144.

Specifically, the uppermost one of the stacked sheets P is picked up by a feed roller 230 (see FIGS. 3 to 13) that is rotated by a feed motor 104. Then, the sheet P is fed toward a transport roller pair 220 (see FIG. 3) at the downstream side in the transport direction while being guided by left and right, sheet guides 103 and 103. The sheet P fed to the transport roller pair 220 is transported toward a recording unit 143 at a further downstream side in the transport direction by a transport driving roller 221 (see FIG. 3) that is rotated by a transport motor (not shown)

The recording unit 143 includes a platen 105 that supports the sheet P from the below and a carriage 107 provided above the platen 105 in an opposing manner. The carriage 107 is moved by a carriage motor 102 while being guided along a carriage guide shaft (not shown) that extends in a man scanning direction, which is the width (X) direction of the sheet P being transported. A recording head 106 that ejects ink toward the sheet P is provided on a bottom surface portion of the carriage 107. The sheet P having data recorded by the recording unit 143 is transported further toward the downstream side and is then discharged from a front side of the recording apparatus 100 by a discharge roller (not shown).

An ink cartridge (not shown) is installed at the lower part of the main body of the recording apparatus 100, and ink is supplied to an ink supply path (not shown) via an ink supply needle (not shown). The ink is then supplied to the recording head 106 of the carriage 107 via an ink supply tube 110. During flushing and cleaning of the recording head 106, ink ejection and suction operations are carried out in an ink suction device 200 as an ejection characteristic maintaining portion that maintains the ejection characteristics of the recording unit 143. The ink suction device 200 includes a cap portion 204 and is thus able to seal the recording head 106 by moving the cap portion 204 up and down.

Figure 3:
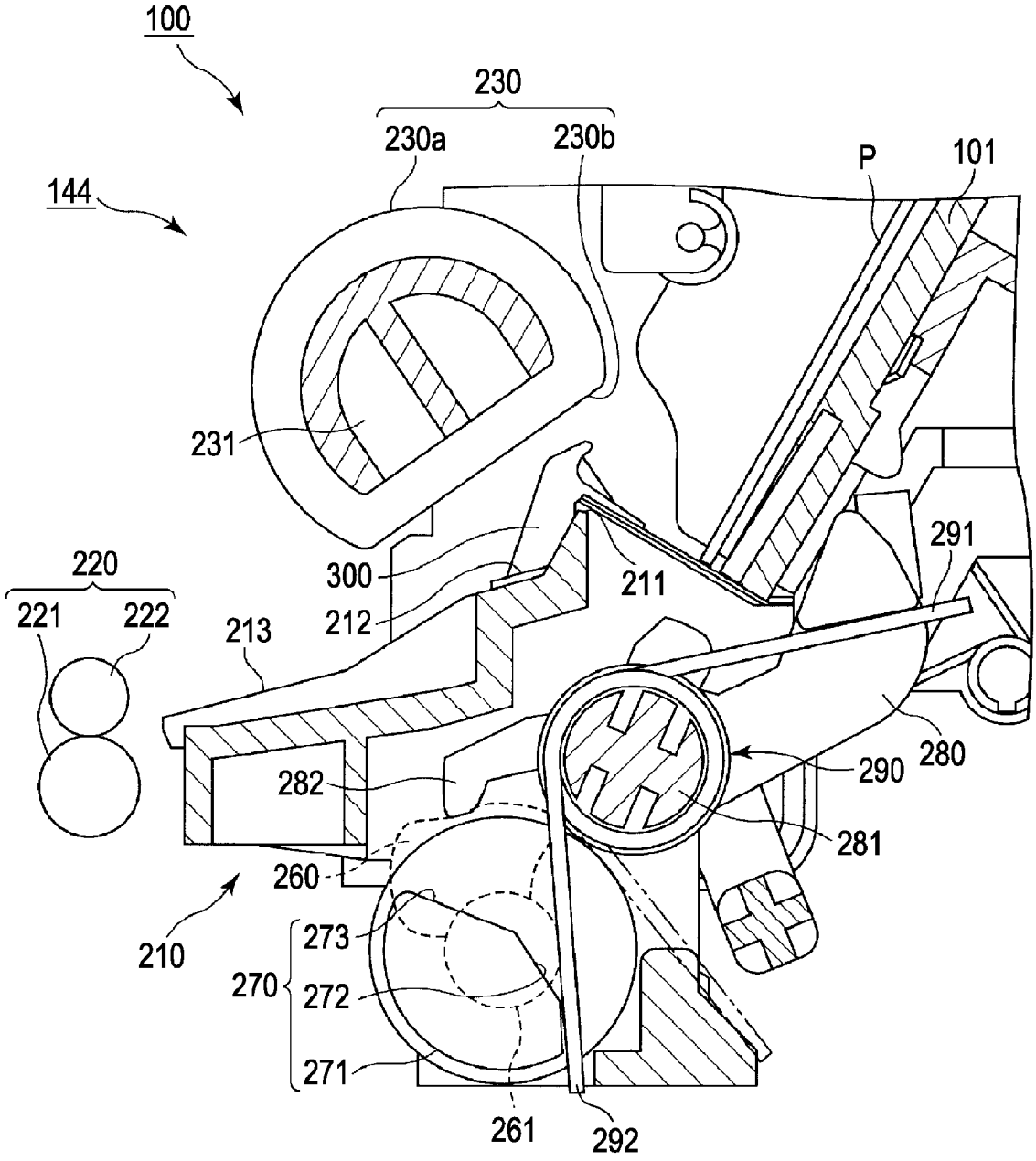
FIG. 3 is a side sectional view illustrating an outline of a feed unit according to the embodiment.

FIG. 3 is a side sectional view illustrating an outline of a feed unit according to the embodiment.

As shown in FIG. 3, the feeding unit 144 of the recording apparatus 100 includes a base portion 210, the feed roller 230, the hopper 101, and a hopper lever 280. The feed roller 230 is fitted to a feed roller shaft 231 and generally has a D shape that has an arch portion 230*a* and a flat portion 230*b*. The hopper lever 280 is integrally formed with a cam follower 282 and is pivotable about a lever shaft 281. Moreover, a hopper cam 260 and a biasing force adjustment cam 270 are formed in a cam shaft 261. The hopper cam 260 engages with the cam follower 282. The biasing force adjustment cam 270 is fan-shaped, and includes an arch portion 271, a first straight portion 272 and a second straight portion 273.

The torsion coil spring 290 as an example of the biasing means is configured such that a first arm portion 291 engages with the hopper lever 280, and a second arm portion 292 makes abutting contact with the biasing force adjustment cam 270.

On the base portion 210, there are formed a width regulation portion 211 capable of preliminarily separating the sheet P being fed, a bank separation portion 212 as an example of the separation means, and a guide surface portion 213 that guides the sheet P to the transport roller pair 220.

The bank separation portion 212 is a pad formed of material having a high friction coefficient. The transport roller pair 220 includes the transport driving roller 221 that is rotated by the transport motor and a transport driven roller 222 that rotates with the rotation of the transport driving roller 221.

In addition, the feeding unit 144 includes a pair of return levers 300 and 300 arranged in the width (X) direction of the sheet P, capable of forcibly returning the separated next or subsequent sheet P back to the hopper 101 upon completion of feeding. The return levers 300 and 300 perform the returning operation by means of the driving force of the feed motor 104.

When the hopper cam 260 is pivoted in the counter-clockwise direction in FIG. 3 and engages with the cam follower 282, the hopper cam 260 causes the hopper lever 280 to pivot in the clockwise direction while resisting against the biasing force of the torsion coil spring 290. As a result, the hopper 101 is displaced from the feed roller 230; this state or operation is a so-called hopper-down state or operation.

On the other hand, when the hopper cam 260 is pivoted further in the counter-clockwise direction in FIG. 3 and is disengaged from the cam follower 282, the hopper lever 280 is pivoted in the counter-clockwise direction by the biasing force of the torsion coil spring 290. As a result, the hopper 101 is moved toward the feed roller 230; this state or operation is a so-called hopper-up state or operation.

When the hopper-up operation is performed, the uppermost sheet P of the sheets P stacked on the hopper 101 is fed by the feed roller 230. Specifically, the next or subsequent sheet P and the uppermost sheet P are preliminarily separated from each other at the width regulation portion 211 of the base portion 210. When the feed roller 230 is pivoted further in the clockwise direction in FIG. 3, the leading end of the sheet P is plunged against the bank separation portion 212 as the separation means. In the present embodiment, the bank separation portion 212 is a pad formed of an elastic body having a high friction coefficient. Moreover, it is configured such that only the uppermost sheet P can climb over the bank separation portion 212.

When the feed roller 230 is pivoted further forward, the leading end of the uppermost sheet P is reached to the transport roller pair 220 while being guided by the guide surface portion 213 of the base portion 210. When the leading end of the sheet P is reached to the transport roller pair 220, a skew removing operation is performed on the sheet P by the transport roller pair 220 and the feed roller 230. The skew removing operation can use a so-called "abutting method" or a so-called "nip and release method."

Here, the "abutting method" causes the leading end of the sheet P to make abutting contact with the transport roller pair 220 in a non-rotating state. Then, the sheet P is deformed between the feed roller 230 and the transport roller pair 220 so that the leading end of the sheet P assumes a posture conforming to the nip line of the transport roller pair 220.

On the other hand, the "nip and release method" causes the leading end of the sheet P to be nipped only a predetermined amount by the transport roller pair 220 that is rotating in the forward direction. Then, the transport roller pair 220 is rotated in the backward direction to thereby deforming the sheet P between the transport roller pair 220 and the feed roller 230 so that the leading end of the sheet P assumes a posture conforming to the nip line of the transport roller pair 220.

After the skew removing operation is performed, the sheet P is transported toward the recording unit 143 by the transport roller pair 220. At this time, the feed roller 230 assumes a posture corresponding to a reset position.

Here, the "reset position" is a posture that the feed roller 230 assumes when the feeding operation is completed, and corresponds to a reference phase angle at which the flat portion 230*b* of the feed roller 230 is opposite the width regulation portion 211 and the hopper 101.

Subsequently, the operation of the biasing force adjustment cam 270 will be described in more detail.

Figure 4A:
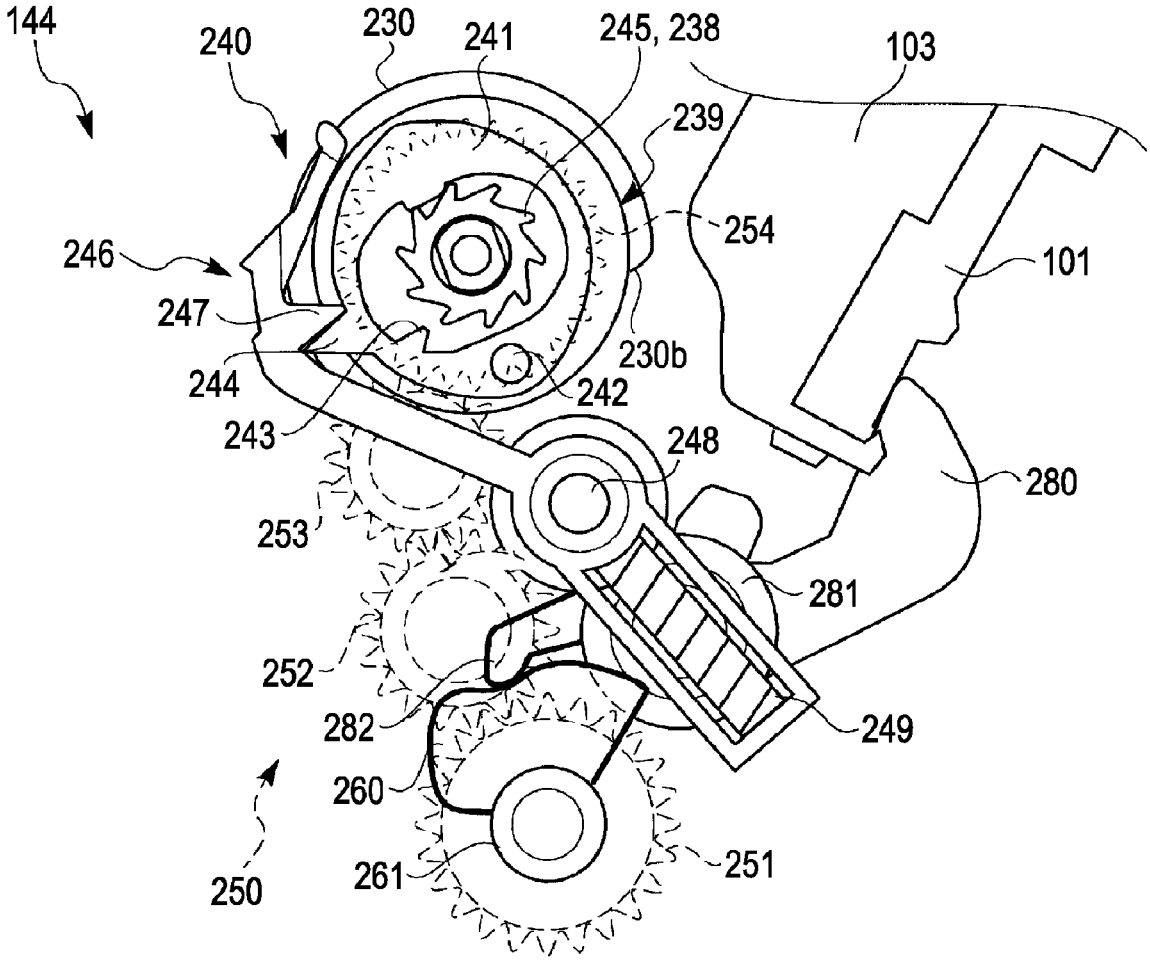
FIGS. 4A and 4B are schematic side views illustrating the operation of the feeding unit (showing the state at a reset position).
Figure 4B:
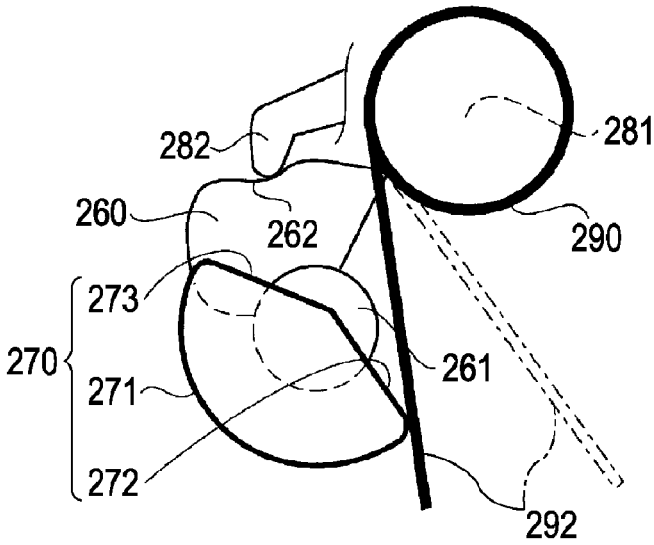

FIGS. 4A and 4B are schematic side views illustrating the operation of the feeding unit, showing the state at a reset position. FIG. 4A is a side view of the hopper lever and a clutch mechanism. FIG. 4B is a side view of the biasing force adjustment cam and the second arm portion of the torsion coil spring shown in FIG. 4A.

As shown in FIG. 4A, the feeding unit 144 includes a clutch mechanism 240. The clutch mechanism 240 is adapted to disconnect the power transmission from the feed motor 104 to the feed roller shaft 231 when the feed roller 230 is at the reset position.

The clutch mechanism 240 includes a first rotating body 238, a second rotating body 239, and a clutch lever 246. The first rotating body 238 has a ratchet wheel 245 at the upstream side in the power transmission direction of the feed motor 104. The second rotating body 239 is configured to rotate integral with the feed roller shaft 231. Moreover, the second rotating body 239 includes a clutch pivot portion 241 capable of pivoting about a pivot point 242.

The clutch pivot portion 241 includes a tooth portion 243 adapted to engage with the ratchet wheel 245 and a first claw portion 244. The clutch lever 246 is pivotable about a pivot shaft 248. Moreover, the clutch lever 246 includes a load resistance portion 249 that generates friction with the pivot shaft 248, and a second claw portion 247 adapted to engage with the first claw portion 244.

Here, the pivot shaft 248 is formed as a separate body from the clutch lever 246. Therefore, when the pivot shaft 248 is rotated in the forward or backward direction by the feed motor 104, the clutch lever 246 is pivoted in that direction.

A power transmission gear train 250 is provided between the feed roller shaft 231 and the cam shaft 261. Specifically, the power transmission gear train 250 includes a first gear 251, a second gear 252, a third gear 253 and a fourth gear 254. The first gear 251 is formed on the cam shaft 261. The second gear 252 is provided so as to engage with the first gear 251, and the third gear 253 is provided so as to engage with the second gear 252. The fourth gear 254 is formed on the feed roller shaft 231 and is adapted to engage with the third gear 253.

As shown in FIGS. 4A and 4B, when the feed roller 230 is at the reset position, the hopper cam 260 engages with the cam follower 282. Therefore, the hopper 101 enters the hopper-down state. Moreover, the first straight portion 272 of the biasing force adjustment cam 270 is at a state where it is in contact with the second arm portion 292 of the torsion coil spring 290. Furthermore, the second claw portion 247 of the clutch lever 246 is at a state where it engages with the first claw portion 244 of the clutch pivot portion 241. Therefore, the tooth portion 243 is at a state where it is completely displaced from the ratchet wheel 245.

The hopper cam 260 has a concave portion 262 having a shape that triggers the pivot operation. Moreover, the cam follower 282 is in contact with the concave portion 262 when it is at the rest position.

Figure 5A:
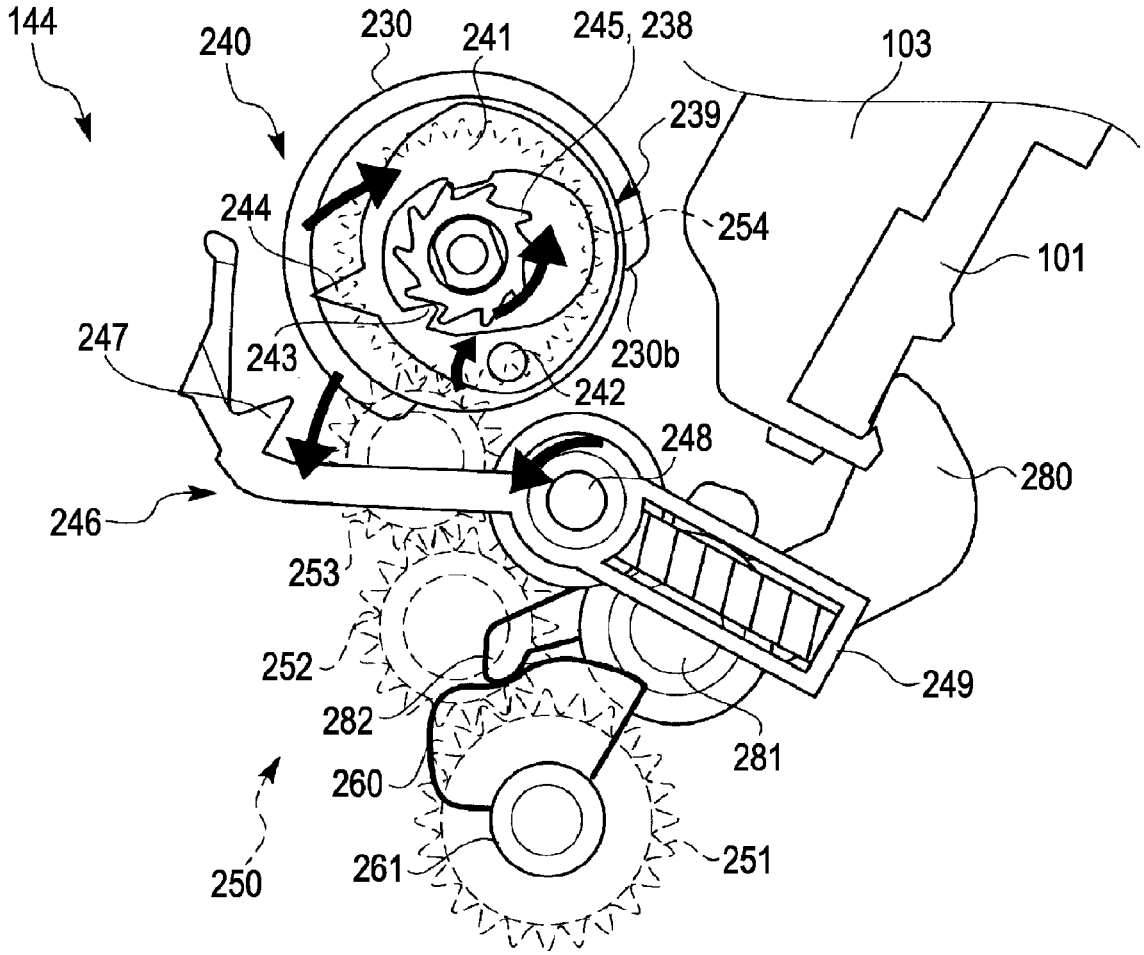
FIGS. 5A and 5B are schematic side views illustrating the operation of the feeding unit (showing the state when a feeding motor rotates backward).
Figure 5B:
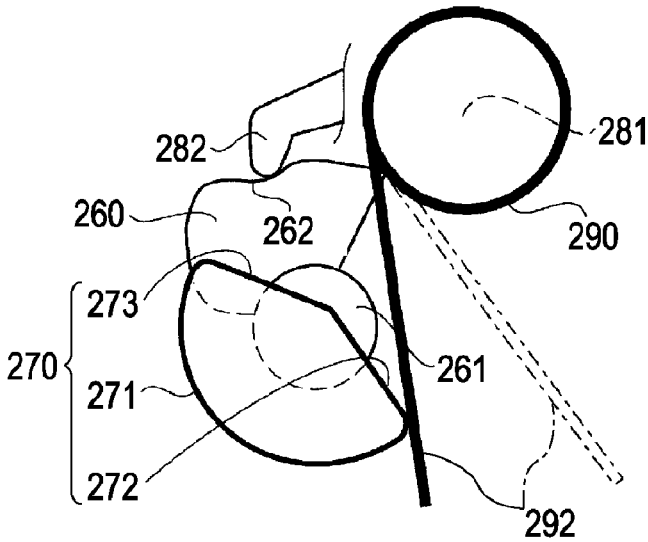

FIGS. 5A and 5B are side views showing the state when the feeding motor rotates in the backward direction by a predetermined amount from the state shown in FIGS. 4A and 4B.

As shown in FIGS. 5A and 5B, when the feed motor 104 rotates in the backward direction, the pivot shaft 248 of the clutch lever 246 is pivoted in the counter-clockwise direction. At this time, as described above, since the load resistance portion 249 is provided to the clutch lever 246, the clutch lever 246 is also pivoted in the counter-clockwise direction. As a result, the first claw portion 244 is disengaged from the second claw portion 247.

The clutch pivot portion 241 is pivoted in the clockwise direction about the pivot point 242 by the biasing force of a biasing spring (not shown). Here, the pivot point 242 is positioned at such a position that the first claw portion 244 is slightly displaced from the pivot shaft 248.

With the backward rotation of the feed motor 104, the ratchet wheel 245 of the first rotating body 238 is pivoted in the counter-clockwise direction. Therefore, when the tooth portion 243 of the clutch pivot portion 241 engages with the ratchet wheel 245, the tooth portion 243 climbs over the claws of the ratchet wheel 245 while colliding with the claws due to the orientation of the claws and thus quiet clicking sound is produced. As a result, the feed motor 104 stops the backward rotation.

Figure 6A:
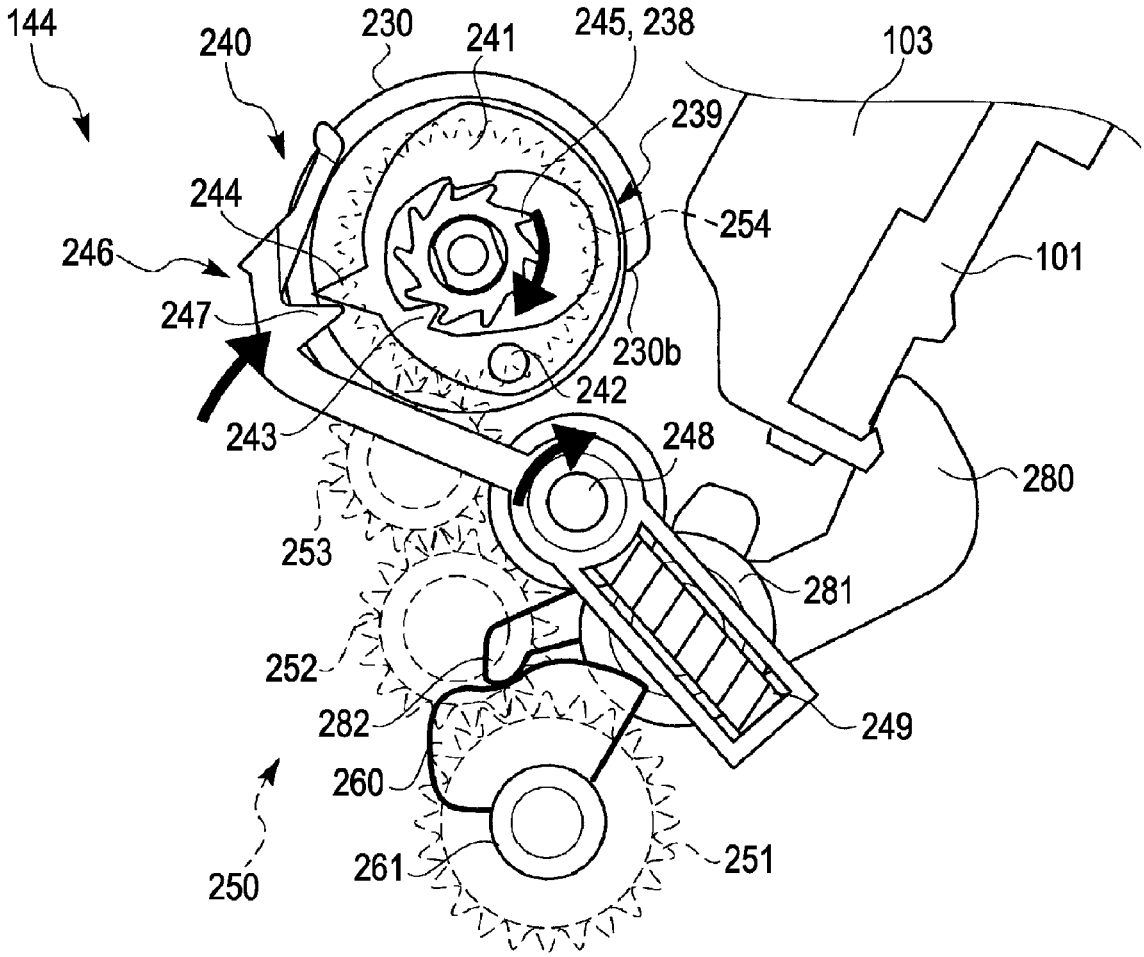
FIGS. 6A and 6B are schematic side views illustrating the operation of the feeding unit (showing the state when a clutch is connected).
Figure 6B:
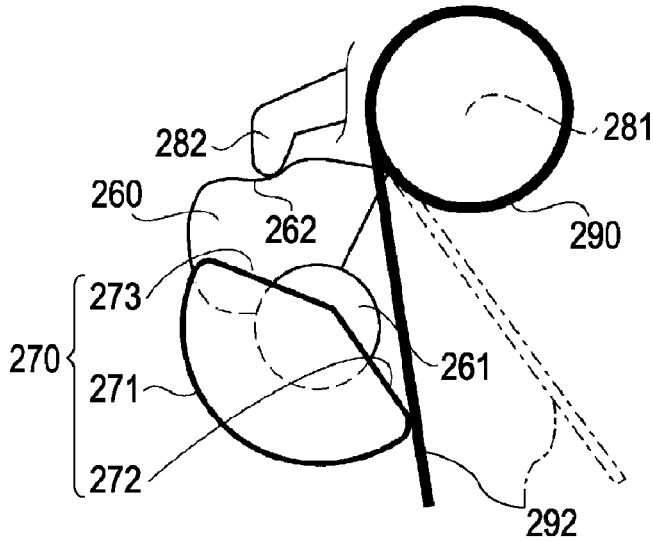

FIGS. 6A and 6B are schematic side views showing the state when the feed motor rotates in the forward direction from the state shown in FIGS. 5A and 5B.

As shown in FIGS. 6A and 6B, when the feed motor 104 rotates in the forward direction, the pivot shaft 248 of the clutch lever 246 and the ratchet wheel 245 of the first rotating body 238 are pivoted in the clockwise direction. Therefore, the clutch lever 246 is also pivoted in the clockwise direction and is moved toward the clutch pivot portion 241. At this time, the second claw portion 247 of the clutch lever 246 is moved toward a counter-clockwise side of the first claw portion 244 of the clutch pivot portion 241.

With the clockwise pivot operation of the ratchet wheel 245, the tooth portion 243 of the clutch pivot portion 241 can engage with the claws of the ratchet wheel 245. Then, driving power is transmitted from the ratchet wheel 245 to the clutch pivot portion 241, whereby the clutch pivot portion 241 begins to be pivoted in the clockwise direction integral with the ratchet wheel 245. That is, the power transmission from the ratchet wheel 245 of the first rotating body 238 to the clutch pivot portion 241 of the second rotating body 239 is switched to a connected state.

Figure 7A:
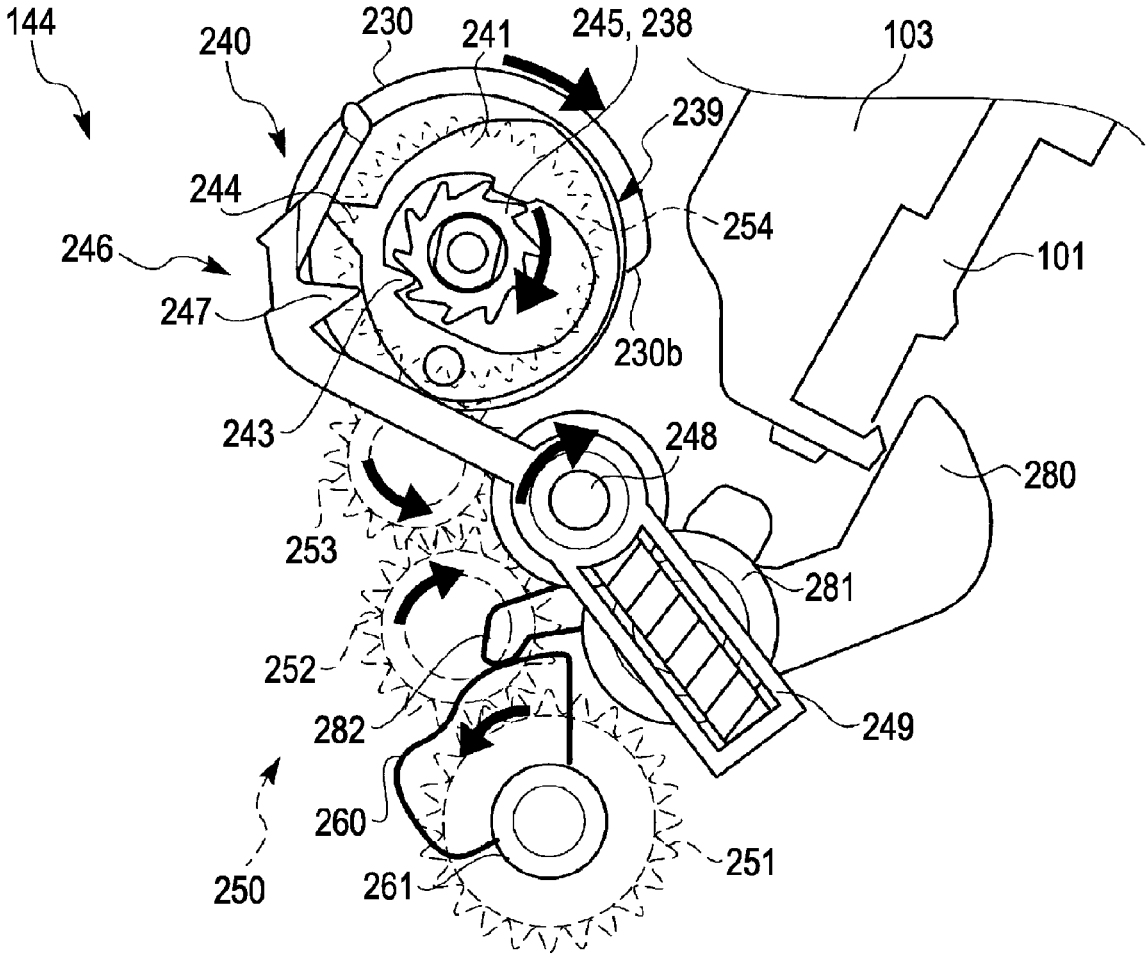
FIGS. 7A and 7B are schematic side views illustrating the operation of the feeding unit (showing the state when a feed roller rotates).
Figure 7B:
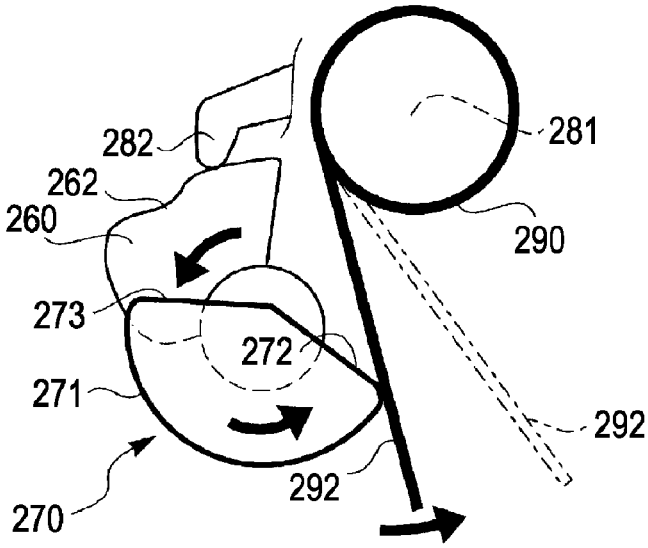

FIGS. 7A and 7B are schematic side views showing the state when the feed roller is rotated further in the forward direction from the state shown in FIGS. 6A and 6B.

As shown in FIGS. 7A and 7B, when the feed motor 104 is rotated further in the forward direction, the second rotating body 239 is pivoted in the clockwise direction integral with the first rotating body 238. Therefore, the feed roller 230 is rotated in the clockwise direction. At this time, the fourth gear 254 formed on the feed roller shaft 231 is rotated in the clockwise direction. Moreover, the third gear 253 is rotated in the counter-clockwise direction, the second gear 252 is rotated in the clockwise direction, and the first gear 251 is rotated in the counter-clockwise direction. Therefore, the hopper cam 260 is pivoted in the counter-clockwise direction. At this time, the biasing force adjustment cam 270 causes the second arm portion 292 of the torsion coil spring 290 to be displaced in the counter-clockwise direction about the lever shaft 281. As a result, the biasing force adjustment cam 270 can increase the biasing force of the torsion coil spring 290 compared with the states shown in FIGS. 4A and 4B to FIGS. 6A and 6B.

Figure 8A:
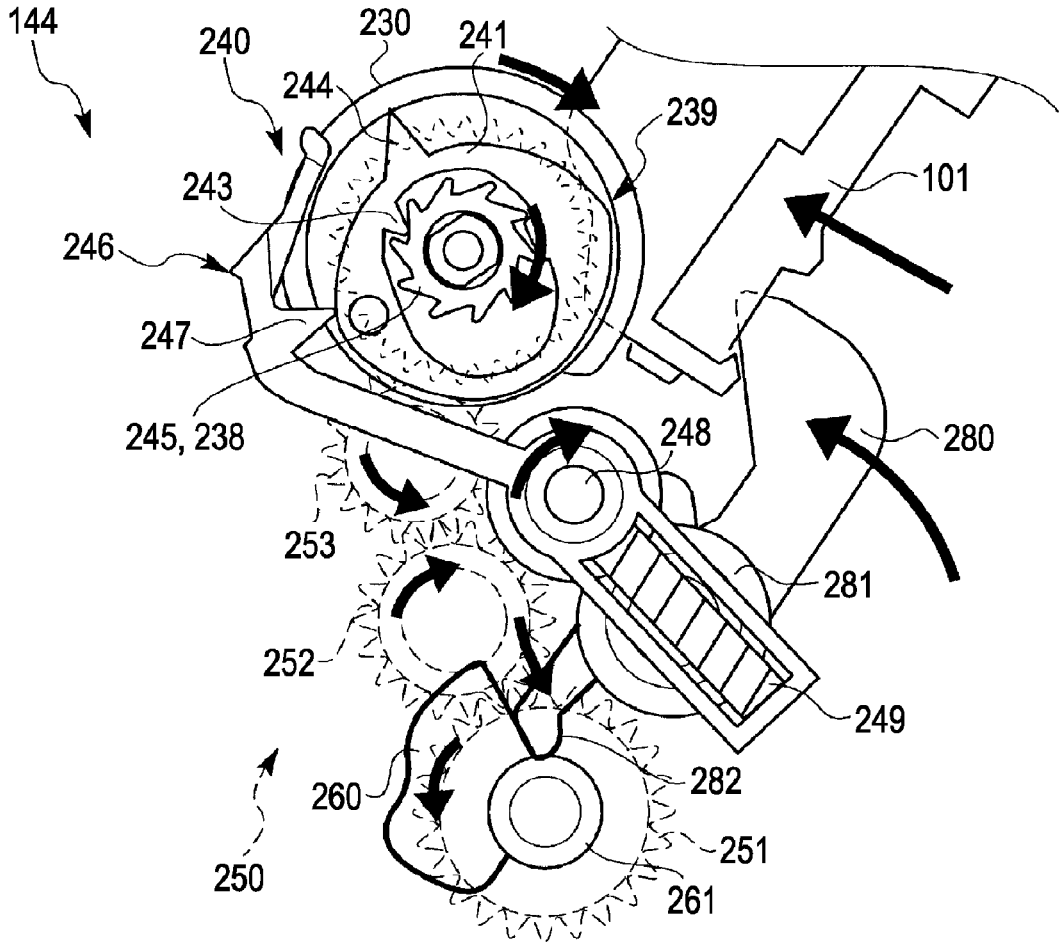
FIGS. 8A and 8B are schematic side views illustrating the operation of the feeding unit (showing the state when a hopper-up is carried out).
Figure 8B:
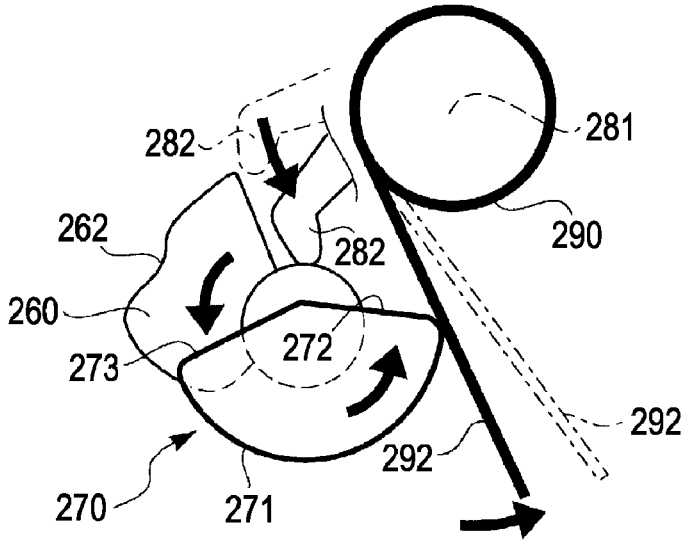

FIGS. 8A and 8B are schematic side views showing the state when the feed motor is rotated further in the forward direction from the state shown in FIGS. 7A and 7B.

As shown in FIGS. 8A and 8B, when the feed motor 104 is rotated further in the forward direction, the first rotating body 238, the second rotating body 239, and the feed roller 230 are rotated further in the forward direction. Therefore, the hopper cam 260 is pivoted further in the counter-clockwise direction. At this time, the hopper cam 260 is disengaged from the cam follower 282. Therefore, the hopper lever 280 is pivoted in the counter-clockwise direction by the biasing force of the torsion coil spring 290. As a result, the hopper 101 enters the hopper-down state.

At this time, since the biasing force adjustment cam 270 is pivoted further in the counter-clockwise direction, the second arm portion 292 of the torsion coil spring 290 is displaced further in the counter-clockwise direction about the lever shaft 281. Moreover, the biasing force of the torsion coil spring 290 is not at Max (the maximum value). Therefore, the feeding unit 144 of the present invention can reduce the collision noise when the hopper 101 and the sheet P stacked thereon collide with the feed roller 230 during the hopper-up operation, compared with the prior feeding device.

Figure 9A:
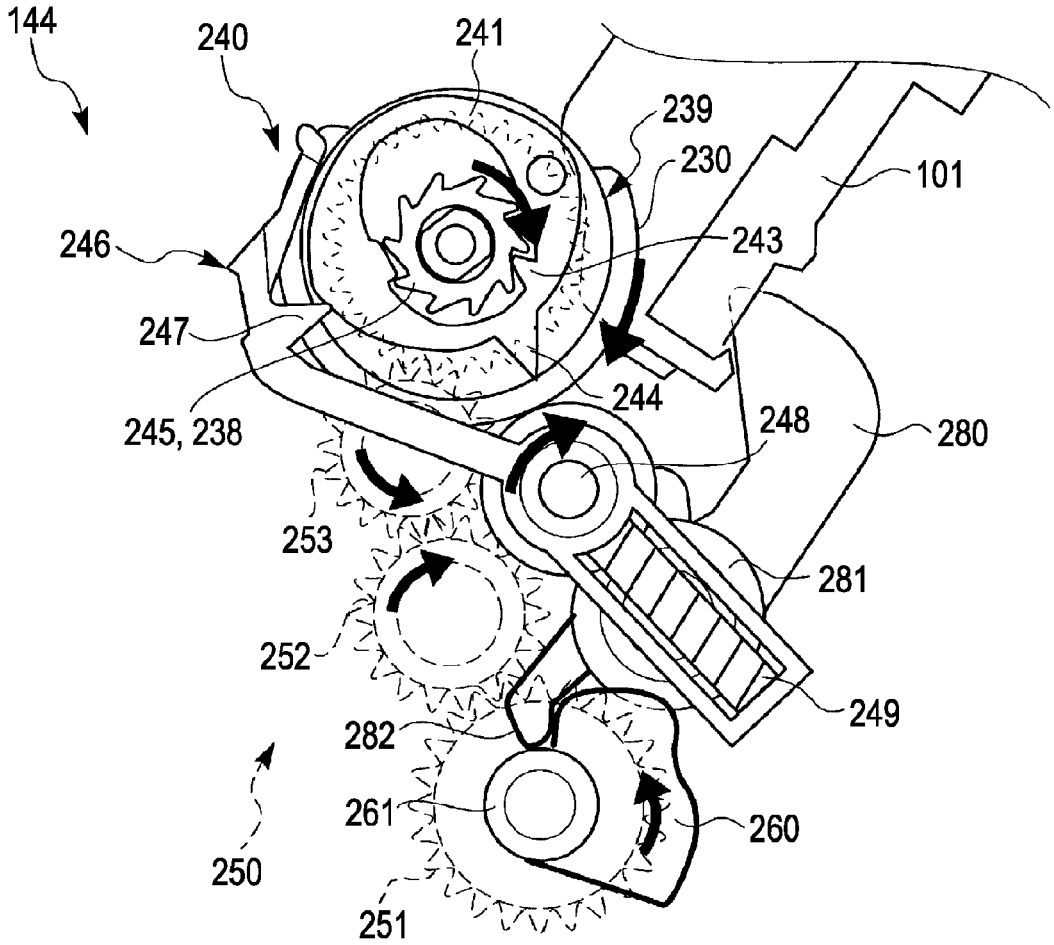
FIGS. 9A and 9B are schematic side views illustrating the operation of the feeding unit (showing the state when a feeding operation is completed).
Figure 9B:
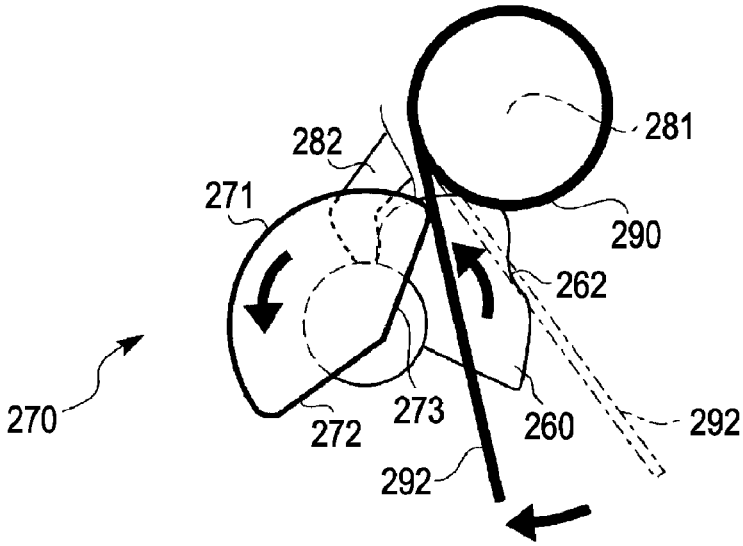

FIGS. 9A and 9B are schematic side views showing the state when the feed motor is rotated further in the forward direction from the state shown in FIGS. 8A and 8B.

As shown in FIGS. 9A and 9B, when the feed motor 104 is rotated further in the forward direction, the first tapered roller bearing 238, the second tapered roller bearing 239, and the feed roller 230 are rotated further in the clockwise direction. At this time, the feed roller 230 picks up the sheet P stacked on the hopper 101 to thereby start a feeding operation.

The biasing force adjustment cam 270 is pivoted further in the counter-clockwise direction, whereby the second arm portion 292 of the torsion coil spring 290 is displaced further in the counter-clockwise direction about the lever shaft 281.

Moreover, the arch portion 271 makes abutting contact with the second arm portion 292. That is, the second arm portion 292 is at a state where it is displaced to the full extent in the counter-clockwise direction. As a result, the biasing force of the torsion coil spring 290 reaches the maximum.

At this time, as described above, it is configured such that the leading end of the sheet P passes through the width regulation portion 211 and climbs over the bank separation portion 212. That is, when the biasing force is reached to the maximum, the force for feeding the sheet P becomes the maximum. Therefore, the leading end of the sheet P can assuredly climb over the bank separation portion 212.

Thereafter, the feed motor 104 is rotated further in the forward direction, whereby the biasing force adjustment cam 270 is pivoted further in the counter-clockwise direction. Then, the end portion of the second straight portion 273 is brought into abutting contact with the second arm portion 292. Therefore, the biasing force adjustment cam 270 can displace the second arm portion 292 in the clockwise direction from the state wherein it is displaced to the full extent in the counter-clockwise direction. As a result, the biasing force of the torsion coil spring 290 can be decreased from the maximum value.

Here, after the leading end of the sheet P has passed through the bank separation portion 212, it is not necessary that the feeding force is at the maximum. Therefore, the feeding force is decreased by decreasing the biasing force. As a result, the biasing force adjustment cam 270 can reduce the energy loss compared with the prior feeding device.

The leading end of the sheet P is at a state where it is nipped by the transport roller pair 220. In other words, the feeding operation of the sheet P is completed.

Here, it is preferable to provide the biasing force adjustment cam 270 with such a shape that the biasing force increases when the skew removing operation is performed on the sheet P and decreases thereafter. By doing this, the sheet P can be easily deformed between the feed roller 230 and the transport roller pair 220. As a result, it is possible to efficiently perform the skew removing operation.

Figure 10A:
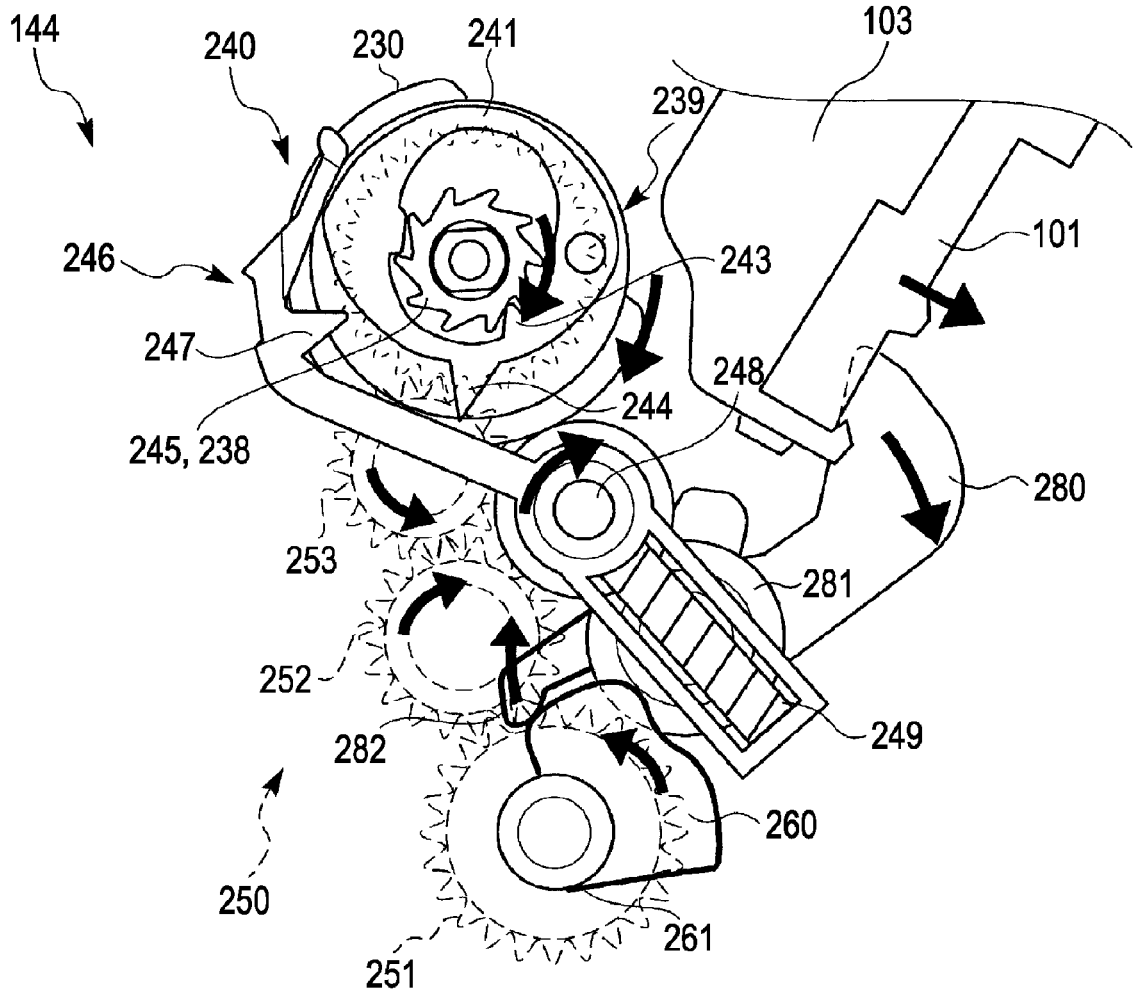
FIGS. 10A and 10B are schematic side views illustrating the operation of the feeding unit (showing the state when a hopper-down is started).
Figure 10B:
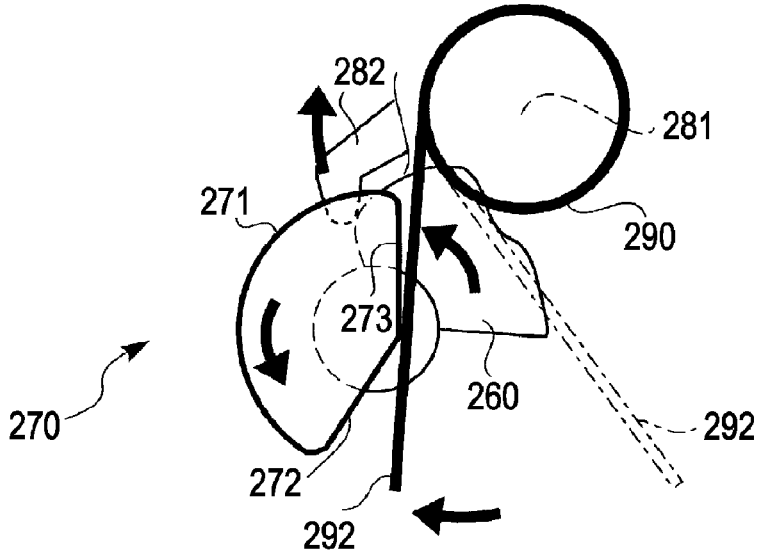

FIGS. 10A and 10B are schematic side views showing the state when the feed motor is rotated further in the forward direction from the state shown in FIGS. 9A and 9B.

As shown in FIGS. 10A and 10B, when the feed motor 104 is rotated further in the forward direction, the first rotating body 238, the second rotating body 239, and the feed roller 230 are rotated further in the clockwise direction. Moreover, the hopper cam 260 is pivoted further in the counter-clockwise direction. Then, the hopper cam 260 makes abutting contact with the cam follower 282 to thereby pivot the hopper lever 280 in the clockwise direction. Therefore, the hopper 101 starts the hopper-down operation.

At this time, an end portion that connects the first straight portion 272 and the second straight portion 273 is in abutting contact with the second arm portion 292. That is, the second arm portion 292 at a state where it is displaced to the full extent in the clockwise direction. Therefore, the biasing force of the torsion coil spring 290 is at Min (minimum value). As a result, the feeding unit 144 can easily perform the hopper-down operation. That is, it is possible to reduce the load applied to the feed motor 104, which is a driving power source for execution of the hopper-down operation.

Moreover, the return levers 300 and 300 are configured to perform the returning operation by means of the driving power of the feed motor 104. Therefore, the biasing force adjustment cam 270 can reduce the peak value of a load torque applied to the feed motor 104.

Figure 11A:
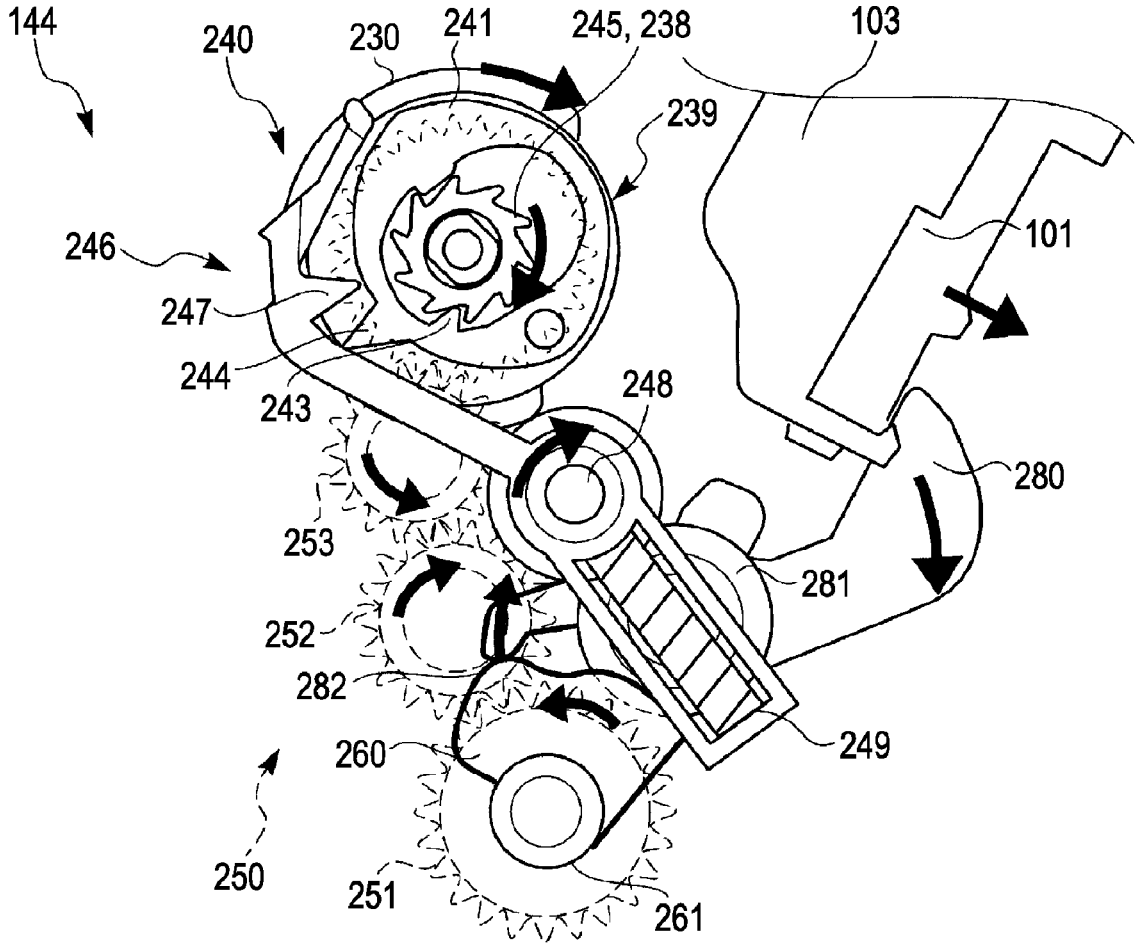
FIGS. 11A and 11B are schematic side views illustrating the operation of the feeding unit (showing the state when the hopper-down is completed).
Figure 11B:
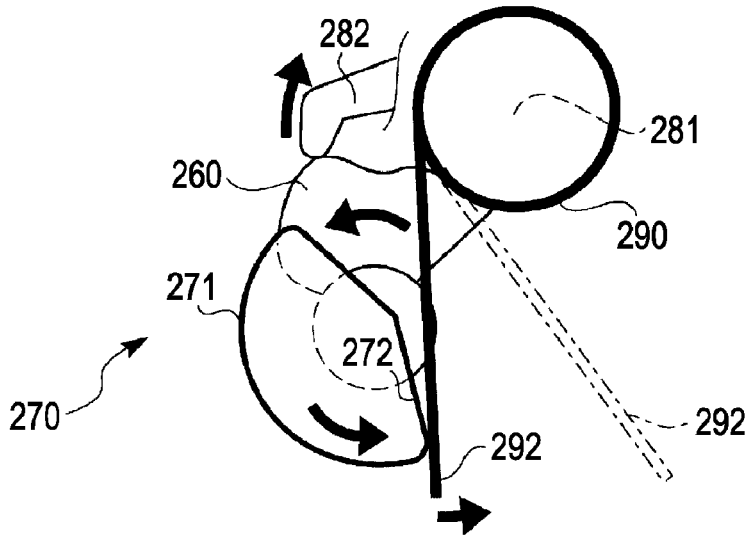

FIGS. 11A and 11B are schematic side views showing the state when the feed motor is rotated further in the forward direction from the state shown in FIGS. 10A and 10B.

As shown in FIGS. 11A and 11B, when the feed motor 104 is rotated further in the forward direction, the first rotating body 238, the second rotating body 239, and the feed roller 230 are rotated further in the clockwise direction. Moreover, the hopper cam 260 is pivoted further in the counter-clockwise direction, whereby the hopper lever 280 is pivoted further in the clockwise direction. Then, the cam follower 282 enters a state wherein it is completely riding on the hopper cam 260. As a result, the hopper-down operation of the hopper 101 is completed. That is, the hopper 101 is at a state where it is displaced to the full extent from the feed roller 230.

The biasing force adjustment cam 270 is pivoted further in the counter-clockwise direction, whereby the second arm portion 292 of the torsion coil spring 290 is slightly displaced in the counter-clockwise direction about the lever shaft 281.

Figure 12A:
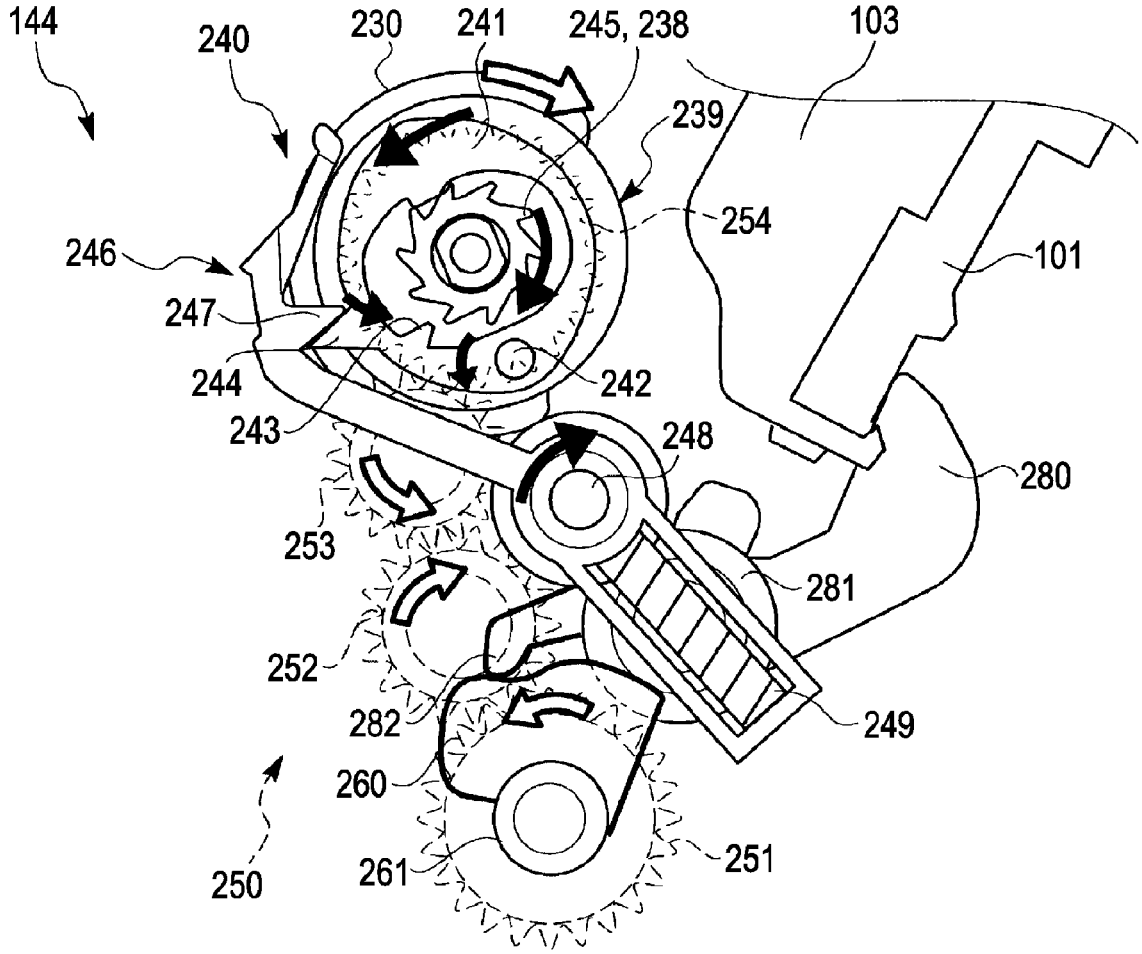
FIGS. 12A and 12B are schematic side views illustrating the operation of the feeding unit (showing the state when the clutch is disconnected).
Figure 12B:
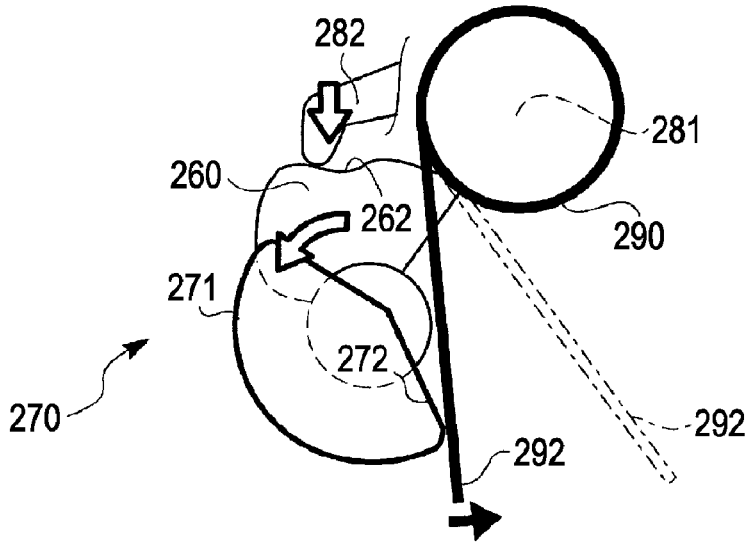

FIGS. 12A and 12B are schematic side views showing the state when the feed motor is rotated further in the forward direction from the state shown in FIGS. 11A and 11B.

As shown in FIGS. 12A and 12B, when the feed motor 104 is rotated further in the forward direction, the first rotating body 238, the second rotating body 239, and the feed roller 230 are rotated further in the clockwise direction. Moreover, the second claw portion 247 of the clutch lever 246 engages with the first claw portion 244 of the clutch pivot portion 241. Therefore, the clutch pivot portion 241 is pivoted in the counter-clockwise direction about the pivot point 242. As a result, the tooth portion 243 is disengaged from the ratchet wheel 245. That is, the power transmission of the clutch mechanism 240 is disconnected. At this time, the feed roller 230 stops at the reset position.

The biasing force adjustment cam 270 is pivoted further in the counter-clockwise direction, whereby the second arm portion 292 of the torsion coil spring 290 is slightly displaced in the counter-clockwise direction about the lever shaft 281. Therefore, it is possible to very slightly increase the biasing force of the torsion coil spring 290 in the hopper-down state. At this time, the very slightly increased biasing force can cause the cam follower 282 to be pressed against the concave portion 262 of the hopper cam 260. Therefore, the hopper cam 260 is applied with a force that pivots the distal end of the cam follower 282 to be guided to the deepest position of the concave portion 262. This another pressing force acts in such a manner as to pivot the hopper cam 260 in the counter-clockwise direction.

At the same time, the force causes the second rotating body 239 to rotate further in the clockwise direction via the first to fourth gears 251 to 254. Therefore, the clutch pivot portion 241 can be pivoted further in the counter-clockwise direction about the pivot point 242 while being regulated by the second claw portion 247 of the clutch lever 246. As a result, the state shown in FIGS. 12A and 12B can return to the state shown in FIGS. 4A and 4B. Moreover, the tooth portion 243 of the clutch pivot portion 241 can be securely disengaged from the ratchet wheel 245, whereby the tooth portion 243 is completely displaced from the ratchet wheel 245. As a result, it is possible to eliminate the possibility that the insufficient displacement causes the clicking sound as described above.

In a case where the concave portion 262 is not provided to the hopper cam 260, it is possible to adjust the biasing force of the torsion coil spring 290 to the Minimum in the hopper-down state.

Moreover, the feeding unit 144 can decrease the biasing force of the torsion coil spring 290 in the hopper-down state compared with the prior feeding device. As a result, the feeding unit 144 can decrease the possibility of the creep deformation in the hopper-down state compared with the prior feeding device.

Figure 13:
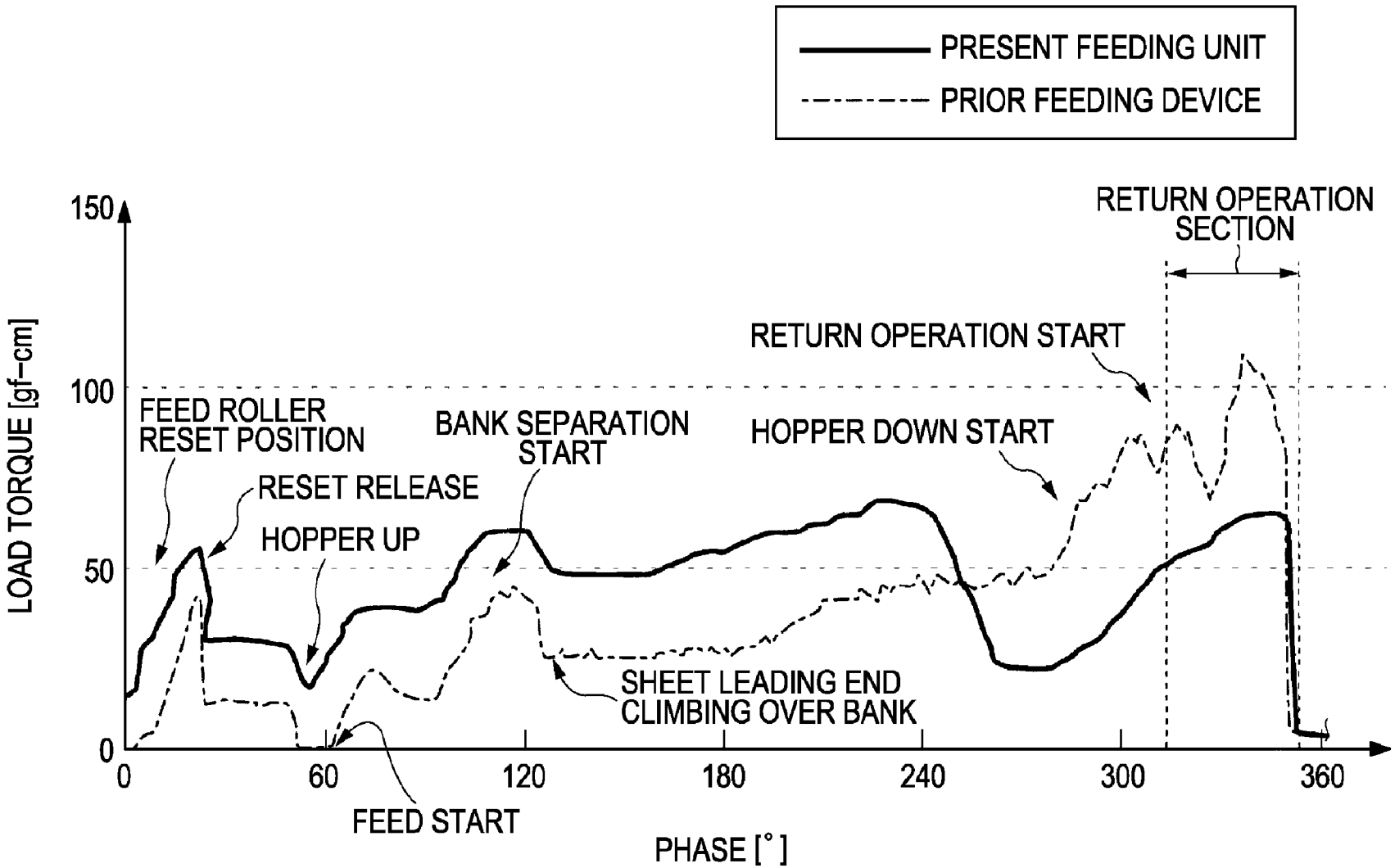
FIG. 13 is a graph illustrating the load torque characteristics.

FIG. 13 is a graph illustrating the motor load torque characteristics. The vertical axis represents the value of a load torque applied to the feed motor, and the horizontal axis represents a phase angle of the feed roller with the reset position used as a reference. The solid line corresponds to the values for the present feeding unit, and the chain line corresponds to the values for the prior feeding device.

Figure 14:
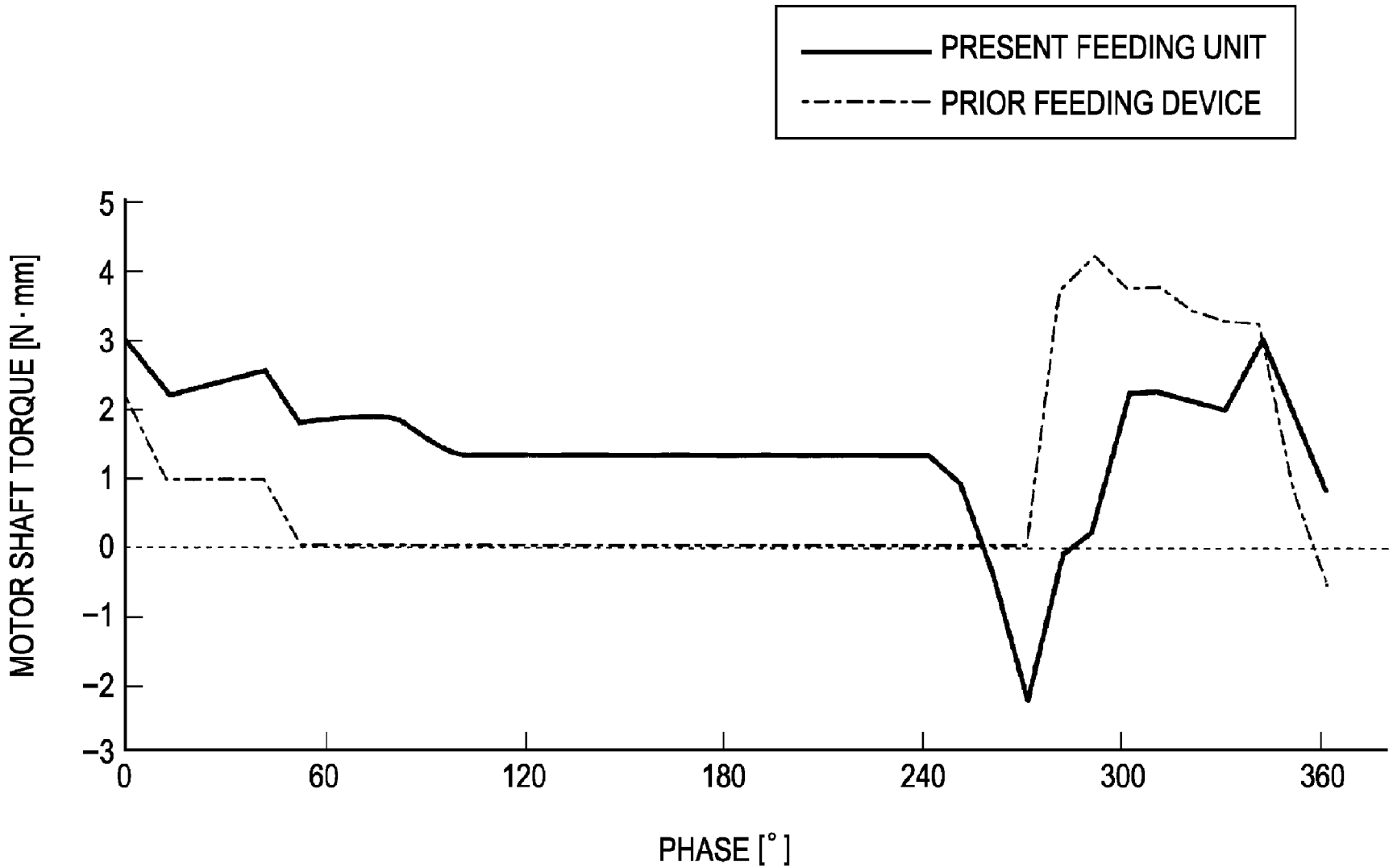
FIG. 14 is a graph illustrating the motor shaft torque characteristics.

FIG. 14 is a graph illustrating the motor shaft torque characteristics. The vertical axis represents the value of a torque applied to the feed motor, and the horizontal axis represents a phase angle of the feed roller with the reset position used as a reference. The solid line corresponds to the values for the present feeding unit, and the chain line corresponds to the values for the prior feeding device.

Here, the torsion coil spring 290 is capable of stacking 20 pages of sheet on the hopper 101. The values in the graph are measured when one page of sheet P is set on the hopper 101.

As shown in FIGS. 13 and 14, the feed roller 230 starts rotating from the reset position of the feed roller 230. In some time later, the hopper-up state is reached as described above. At this time, since the hopper cam 260 is disengaged from the cam follower 282, the torque of the feed motor 104 decreases.

Subsequently, the feeding operation of the sheet P is started. Therefore, the torque value of the feed motor 104 begins to increase.

Thereafter, the leading end of the sheet P is plunged against the bank separation portion 212; therefore, the torque value of the feed motor 104 increases. When the leading end of the sheet P climbs over the bank separation portion 212, the frictional resistance acting on the leading end of the sheet P decreases, and therefore, the torque value of the feed motor 104 begins to decrease.

When the sheet P is fed to reach the transport roller pair 220, a skew removing operation is performed thereon.

In the present invention, when the feed roller 230 is rotated by a phase angle of about 220 degrees, the biasing force of the torsion coil spring 290 begins to decrease by the biasing force adjustment cam 270.

When the feed roller 230 is rotated by a phase angle of about 280 degrees, the hopper-down operation is started in the present feeding unit 144 and the prior feeding device. At this time, in the present invention, since the biasing force of the torsion coil spring 290 is preliminarily decreased, the torque value of the feed motor 104 is lower than that of the prior feeding device. That is, in the present invention, since the load applied to the feed motor 104 is small, it is possible to easily perform the hopper-down operation compared with the prior feeding device.

When the biasing force is decreased by the biasing force adjustment cam 270, the second arm portion 292 applies force that pivots the biasing force adjustment cam 270. Therefore, the torque on the shaft of the feed motor 104 has a negative value.

When the feed roller 230 is rotated by a phase angle of about 300 degrees, the return levers 300 and 300 start a returning operation, whereby the torque value of the feed motor 104 begins to increase. Thereafter, the hopper-down operation is completed, and the returning operation is also completed.

The feeding unit 144 as the feeding device according to the present embodiment includes the hopper 101 as the stacking portion on which the sheets P as an example of the recording medium rare stacked; the feed roller 230 that feeds the recording medium stacked on the hopper; the hopper lever 280 as the biasing means for applying biasing force to either the hopper 101 or the feed roller 230 to thereby decrease the distance between the hopper 101 and the feed roller 230; the torsion coil spring 290; the biasing force adjustment cam 270 and the second arm portion 292 as the biasing force adjustment means for adjusting the magnitude of the biasing force of the torsion coil spring 290.

The biasing force adjustment means according to the present embodiment includes the biasing force adjustment cam 270 as the cam portion. The biasing means includes the torsion coil spring 290. The hopper 101 is biased via the hopper lever 280 against the first arm portion 291, which is one end of the torsion coil spring 290. The second arm portion 292, which is the other end of the torsion coil spring 290, engages with the biasing force adjustment cam 270.

Moreover, the feeding unit 144 according to the present embodiment includes the feed motor 104 and the hopper cam 260 as the displacing means for decreasing the distance. The biasing force adjustment cam 270 starts decreasing the biasing force before the distance is increased.

Furthermore, the feeding unit 144 according to the present embodiment includes the feed motor 104, the cam follower 282, and the hopper cam 260 as the displacing means for increasing the distance. The biasing force adjustment cam 270 adjusts the biasing force to the minimum value when the distance is increased by the feed motor 104, the cam follower 282, and the hopper cam 260 as the displacing means.

In addition, the feeding unit 144 according to the present embodiment includes the bank separation portion 212 as the separation portion capable of separating overlapped sheets P which are fed on the downstream side in the feeding direction of the feed roller 230. The biasing force adjustment cam 270 increases the biasing force after the distance is decreased and until the leading end of the sheet P being fed passes through the bank separation portion 212.

In addition, the feeding unit 144 according to the present embodiment includes the transport roller pair 220 that transports the sheet P fed on the downstream side in the feeding direction of the bank separation portion 212 toward the downstream side. The biasing force adjustment cam 270 decreases the biasing force after the leading end of the sheet P being fed is passed through the bank separation portion 212 and immediately before the leading end reaches the transport roller pair 220.

In the present embodiment, the biasing force adjustment means increases the biasing force after the leading end of the sheet P being fed is reached to the transport roller pair 220 and until a skew removing operation is completed.

The recording apparatus 100 according to the present embodiment includes the feeding unit 144 that feeds the stacked sheets P; and the recording unit 143 that records data or images on the sheet P fed from the feeding unit 144 by means of the recording head 106.

The feeding method according to the present embodiment includes biasing either the hopper 101 on which the sheets P are stacked or the feed roller 230 that feeds the sheets P stacked on the hopper 101 against the first arm portion 291, which is one end of the torsion coil spring 290, to thereby decreasing the distance between the hopper 101 and the feed roller 230; and displacing the second arm portion 292, which is the other end of the torsion coil spring 290, to thereby feed the sheet P.

Modified Embodiment 1

Figure 15:
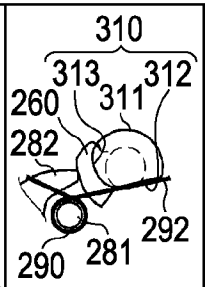
FIG. 15 is a diagram illustrating the operation of a biasing force adjustment cam according to a first modified embodiment (at phase angles ranging from 0 to 90 degrees).
Figure 15:
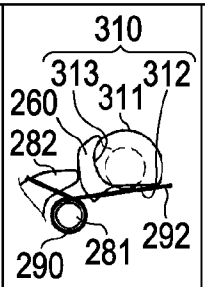
Figure 15:
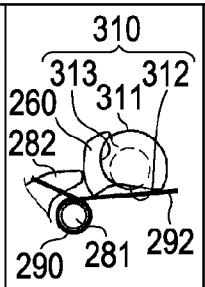
Figure 15:
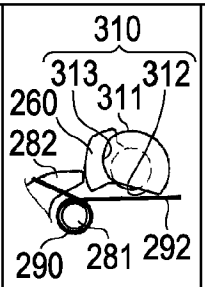
Figure 15:
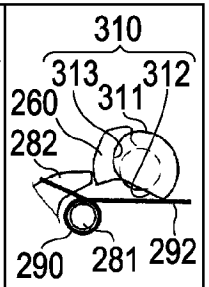
Figure 15:
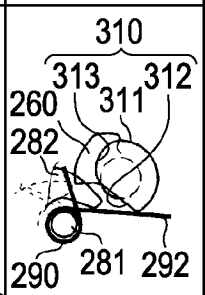
Figure 15:
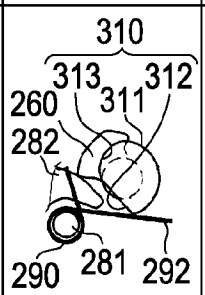
Figure 15:
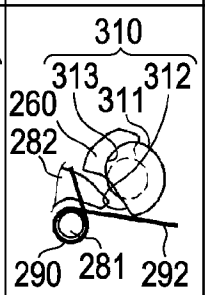
Figure 15:
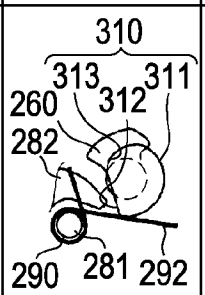
Figure 15:
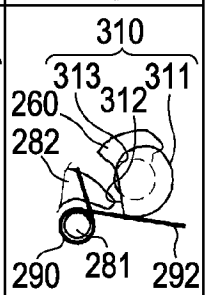
Figure 16:
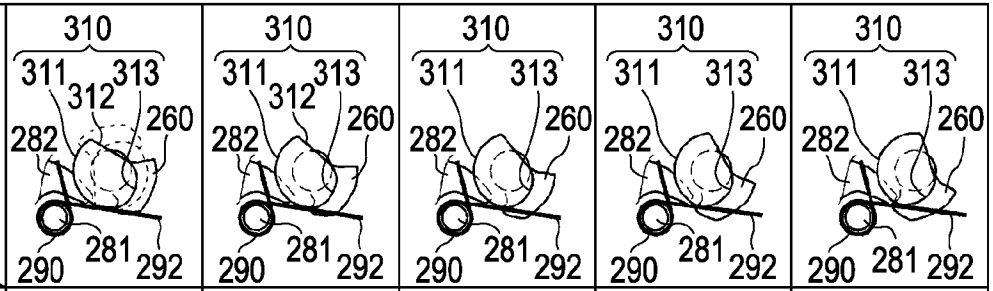
FIG. 16 is a diagram illustrating the operation of the biasing force adjustment cam according to the first modified embodiment (at phase angles ranging from 100 to 320 degrees).
Figure 16:
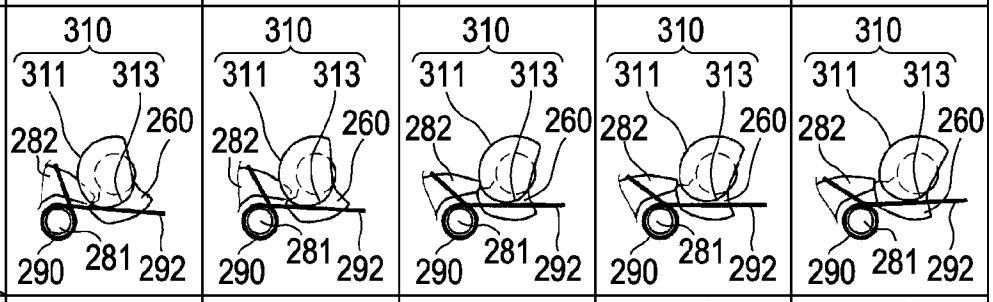
Figure 17:
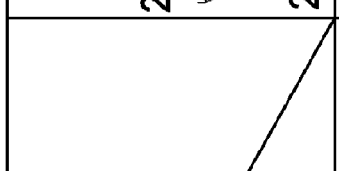
FIG. 17 is a diagram illustrating the operation of the biasing force adjustment cam according to the first modified embodiment (at phase angles ranging from 330 to 360 degrees).

FIG. 15 is a diagram illustrating the operation of a biasing force adjustment cam according to a first modified embodiment, showing the operation at phase angles ranging from 0 (reset position) to 90 degrees. FIG. 16 is a diagram illustrating the operation at phase angles ranging from 100 to 320 degrees. FIG. 17 is a diagram illustrating the operation at phase angles ranging from 330 to 360 degrees. Here, the reset position is substantially the same as a phase angle of 360 degrees.

In FIGS. 15 to 17, the cam position is a phase angle of the feed roller relative to a phase angle of the biasing force adjustment cam when the feed roller is at the reset position. The hopper force is a force that the hopper applies to the feed roller. The spring moment is the biasing force of the torsion coil spring. The cam shaft load T (torque) is a load applied to the cam shaft. The lever shaft load T (torque) is a load applied to the lever shaft. The total cam shaft load T is the sum of the cam shaft load T and the lever shaft load T. The motor shaft torque is a load applied to the shaft of the feed motor.

As shown in FIGS. 15 to 17, a biasing force adjustment cam 310 according to the first modified embodiment includes an arch portion 311, a flat portion 312, and a diameter changing portion 313.

Other components or elements are the same as those of the embodiment described above and will be denoted by the same reference numerals, and therefore, descriptions thereof will be omitted.

When the feed motor 104 rotates in the forward direction, the biasing force adjustment cam 310 is pivoted in the clockwise direction in the drawings. Then, the biasing force adjustment cam 310 displaces the second arm portion 292 in the clockwise direction about the lever shaft 281. When the cam position is at a phase angle of 50 degrees, the hopper-up operation is carried out.

Thereafter, the biasing force is increased by the biasing force adjustment cam 310 until the cam position is reached to a phase angle of 90 degrees.

The biasing force is decreased by the biasing force adjustment cam 310 when the cam position is at phase angles ranging from 240 to 270 degrees. When the cam position is at a phase angle of 280 degrees, the hopper-down operation is carried out.

The biasing force adjustment cam 310 is adapted to be pivoted in synchronism with the feed roller 230. Therefore, the feeding operation of the sheet P and the operation of the hopper 101 are carried out in the same manner as the embodiment described above.

Figure 21:
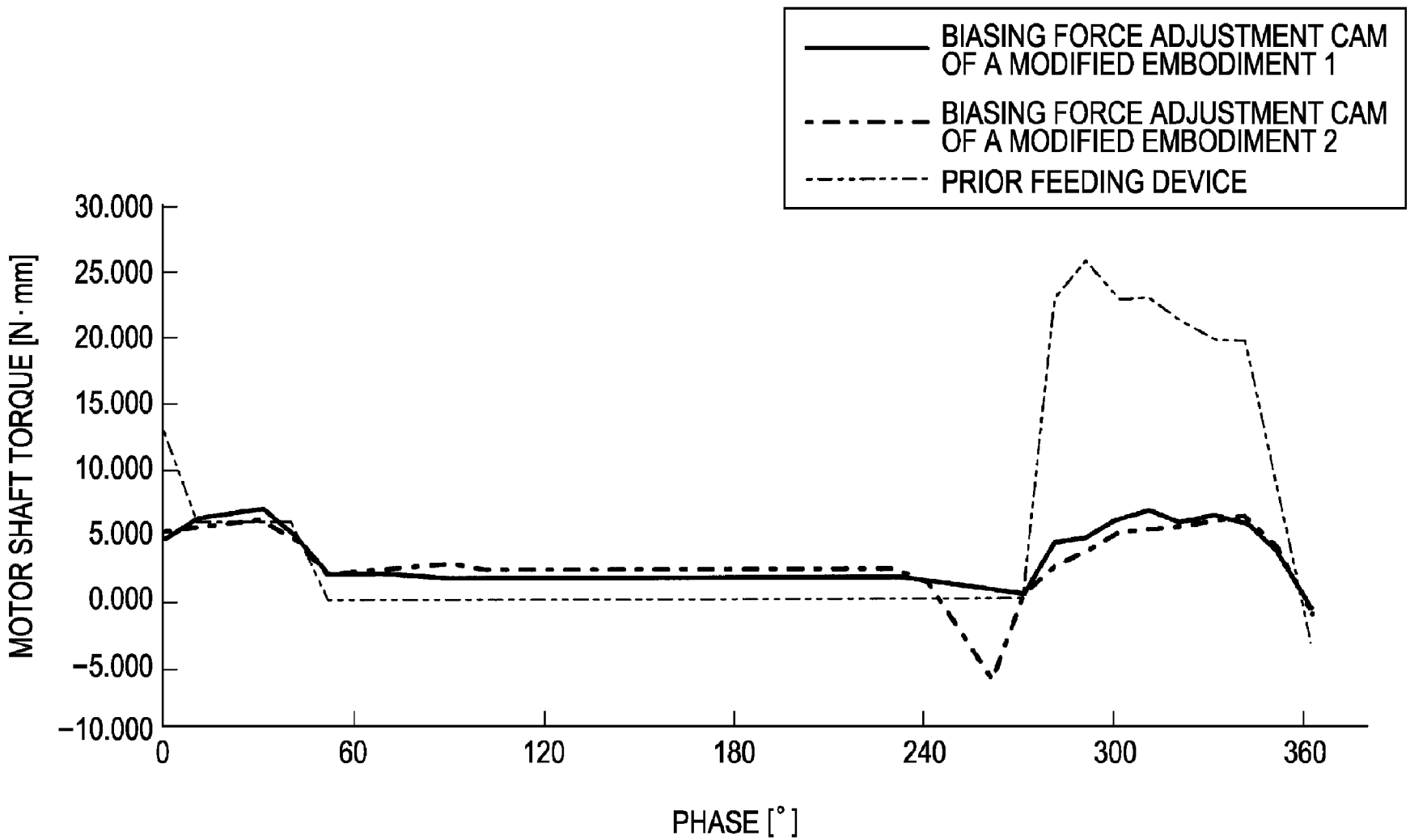
FIG. 21 is a graph illustrating the motor shaft torque characteristics according to first and second modified embodiments.

As a result of using the biasing force adjustment cam 310 according to the first modified embodiment, it is possible to decrease the peak value of the load applied to the shaft of the feed motor 104 when the hopper-down operation is performed, compared with the prior feeding device (see FIG. 21). That is, the configuration according to the first modified embodiment can decrease the energy loss compared with the prior feeding device.

The biasing force adjustment means according to the first modified embodiment includes the biasing force adjustment cam 310 as the cam portion. The biasing means includes the torsion coil spring 290. The hopper 101 is biased via the hopper lever 280 against the first arm portion 291, which is one end of the torsion coil spring 290. The second arm portion 292, which is the other end of the torsion coil spring 290, engages with the biasing force adjustment cam 310.

Modified Embodiment 2

Figure 18:
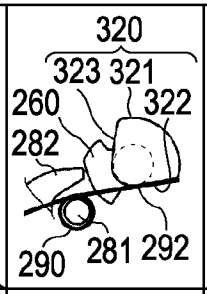
FIG. 18 is a diagram illustrating the operation of a biasing force adjustment cam according to a second modified embodiment (at phase angles ranging from 0 to 90 degrees).
Figure 18:
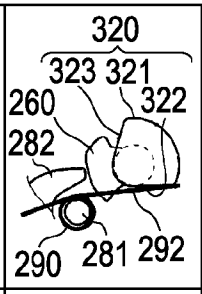
Figure 18:
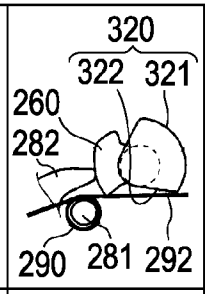
Figure 18:
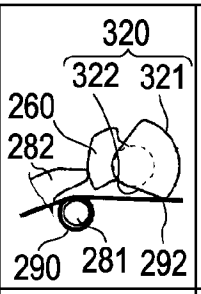
Figure 18:
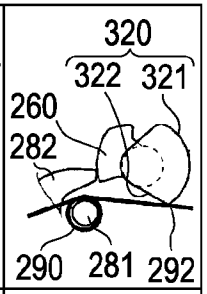
Figure 18:
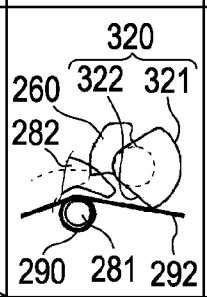
Figure 18:
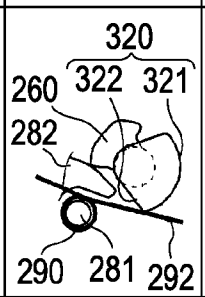
Figure 18:
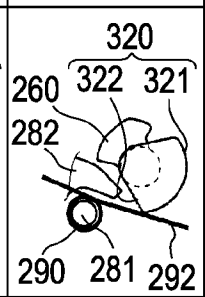
Figure 18:
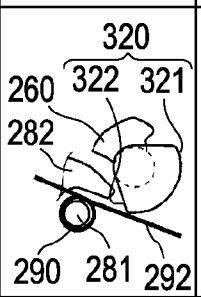
Figure 18:
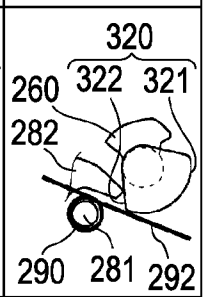
Figure 19:
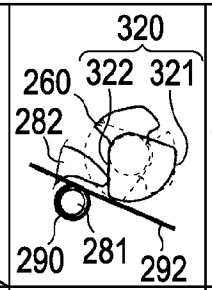
FIG. 19 is a diagram illustrating the operation of the biasing force adjustment cam according to the second modified embodiment (at phase angles ranging from 100 to 320 degrees).
Figure 19:
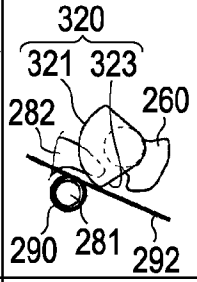
Figure 19:
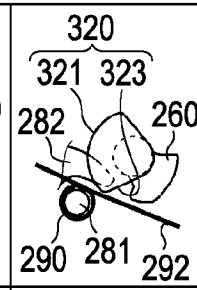
Figure 19:
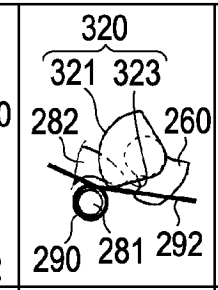
Figure 19:
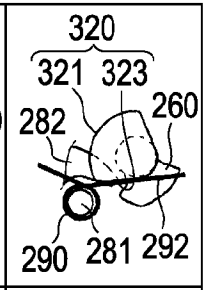
Figure 19:
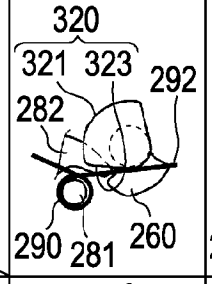
Figure 19:
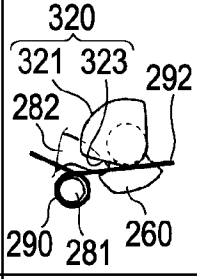
Figure 19:
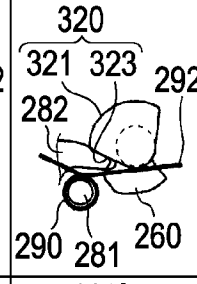
Figure 19:
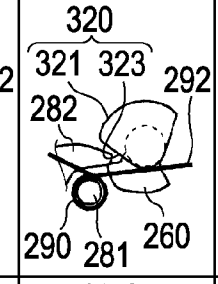
Figure 19:
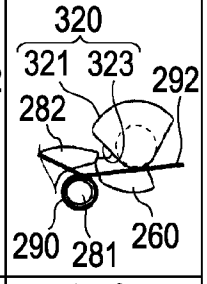
Figure 20:
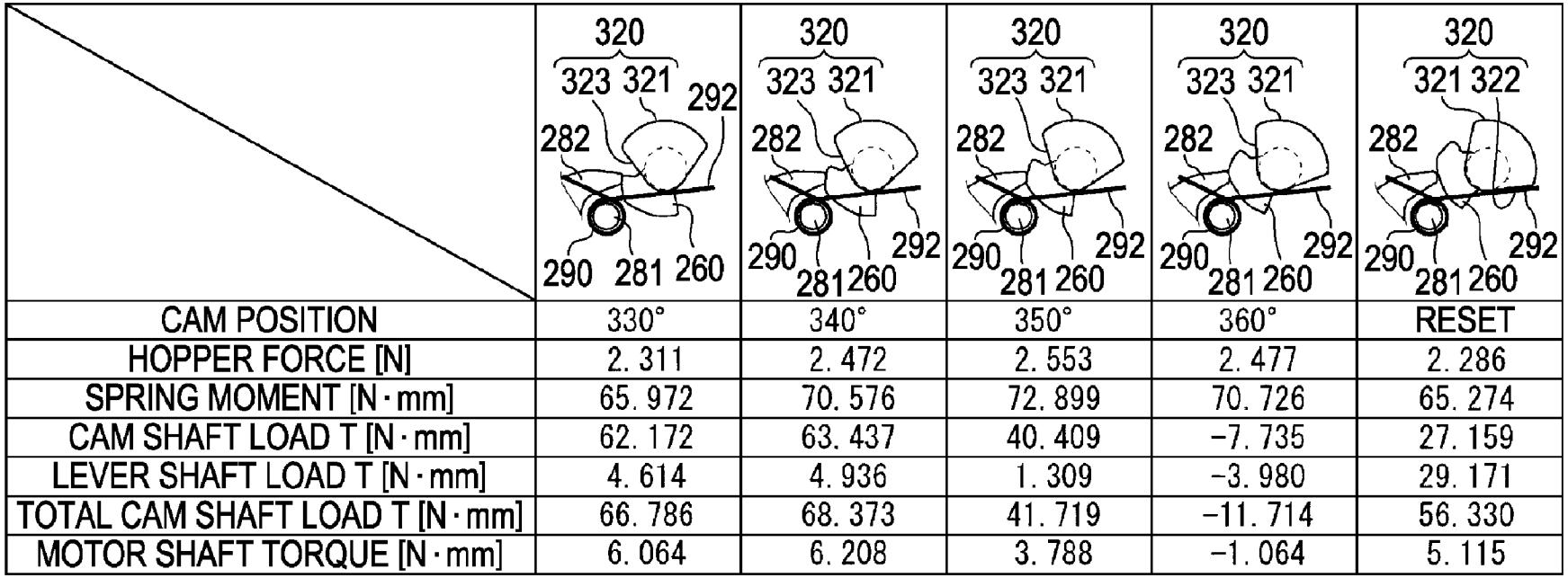
FIG. 20 is a diagram illustrating the operation of the biasing force adjustment cam according to the second modified embodiment (at phase angles ranging from 330 to 360 degrees).

FIG. 18 is a diagram illustrating the operation of a biasing force adjustment cam according to a second modified embodiment, showing the operation at phase angles ranging from 0 to 90 degrees. FIG. 19 is a diagram illustrating the operation at phase angles ranging from 100 to 320 degrees. FIG. 20 is a diagram illustrating the operation at phase angles ranging from 330 to 360 degrees. In FIGS. 18 to 20, the cam position is a phase angle of the feed roller relative to a phase angle of the biasing force adjustment cam when the feed roller is at the reset position. The hopper force is a force that the hopper applies to the feed roller. The spring moment is the biasing force of the torsion coil spring. The cam shaft load T (torque) is a load applied to the cam shaft. The lever shaft load T (torque) is a load applied to the lever shaft. The total cam shaft load T is the sum of the cam shaft load T and the lever shaft load T. The motor shaft torque is a load applied to the shaft of the feed motor.

As shown in FIGS. 18 to 20, a biasing force adjustment cam 320 according to the second modified embodiment includes an arch portion 321, a first straight portion 322, and a second straight portion 323.

Other components or elements are the same as those of the embodiment described above and will be denoted by the same reference numerals, and therefore, descriptions thereof will be omitted.

When the feed motor 104 rotates in the forward direction, the biasing force adjustment cam 320 is pivoted in the clockwise direction in the drawings. Then, the biasing force adjustment cam 320 displaces the second arm portion 292 in the clockwise direction about the lever shaft 281. When the cam position is at a phase angle of 50 degrees, the hopper-up operation is carried out.

Thereafter, the biasing force is increased by the biasing force adjustment cam 320 until the cam position is reached to a phase angle of 90 degrees.

The biasing force is decreased by the biasing force adjustment cam 320 when the cam position is at phase angles ranging from 230 to 270 degrees. When the cam position is at a phase angle of 280 degrees, the hopper-down operation is carried out.

The biasing force adjustment cam 320 is adapted to be pivoted in synchronism with the feed roller 230. Therefore, the feeding operation of the sheet P and the operation of the hopper 101 are carried out in the same manner as the embodiment described above.

FIG. 21 is a graph illustrating the motor load torque characteristics according to the first and second modified embodiments. The vertical axis represents the torque value on the shaft of the feed motor 104, and the horizontal axis represents a phase angle of the feed roller 230 with the reset position used as a reference. The solid line corresponds to the values for the first modified embodiment, the chain line corresponds to the values for the second modified embodiment, and the two-dot chain line corresponds to the values for the prior feeding device.

Here, the torsion coil spring is capable of stacking 50 pages of sheet on the hopper 101. The values in the graph are measured when one page of sheet P is set on the hopper 101.

As shown in FIG. 21, as a result of using the biasing force adjustment cam 310 according to the first modified embodiment and the biasing force adjustment cam 320 according to the second modified embodiment, it is possible to decrease the biasing force when the hopper-down operation is performed and to thus decrease the motor shaft torque compared with the prior feeding device. That is, the configurations according to the first and second modified embodiments can decrease the energy loss compared with the prior feeding device. In particular, in the case the feeding unit 144 of the recording apparatus 100 capable of stacking many pages of sheet on the hopper 101, it is necessary to use the torsion coil spring 290 having stronger biasing force. Therefore, in such a case, the biasing force adjustment cams 270, 310, and 320 (330 and 340) are especially useful.

The biasing force adjustment cam 320 according to the second modified embodiment has a negative torque value when the cam position is at a phase angle of about 260 degrees. This is because the second straight portion 323 is configured to receive a pivoting force from the second arm portion 292 and be pivoted by only the force.

The biasing force adjustment means according to the second modified embodiment includes the biasing force adjustment cam 320 as the cam portion. The biasing means includes the torsion coil spring 290. The hopper 101 is biased via the hopper lever 280 against the first arm portion 291, which is one end of the torsion coil spring 290. The second arm portion 292, which is the other end of the torsion coil spring 290, engages with the biasing force adjustment cam 320.

Modified Embodiment 3

FIGS. 22A to 22O are diagrams illustrating the operation of a biasing force adjustment cam according to a third modified embodiment, showing the operation at phase angles ranging from 0 to 270 degrees. Specifically, FIGS. 22A to 22J are diagrams illustrating the operation at phase angles ranging from 0 (reset position) to 90 degrees at intervals of 10 degrees. FIG. 22K is a diagram illustrating the operation at phase angles ranging from 100 to 230 degrees. FIGS. 22L to 22O are diagrams illustrating the operation at phase angles ranging from 240 to 270 degrees at intervals of 10 degrees.

Figure 23A:
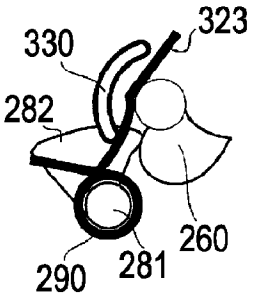
FIGS. 23A to 23J are diagrams illustrating the operation of the biasing force adjustment cam according to the third modified embodiment (at phase angles ranging from 280 to 360 degrees).
Figure 23B:
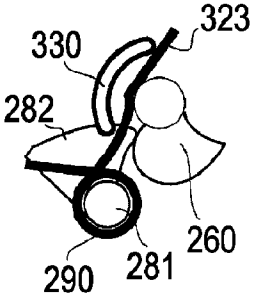
Figure 23C:
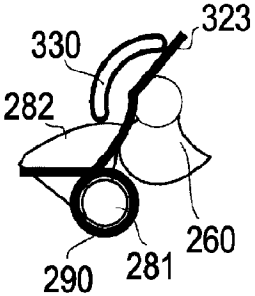
Figure 23D:
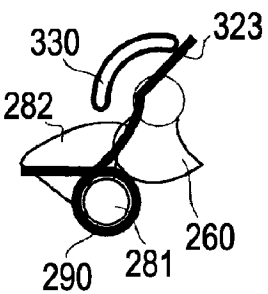
Figure 23E:
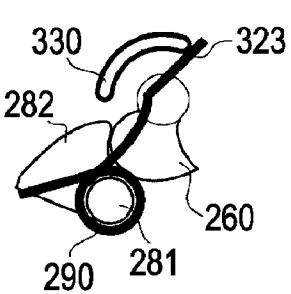
Figure 23F:
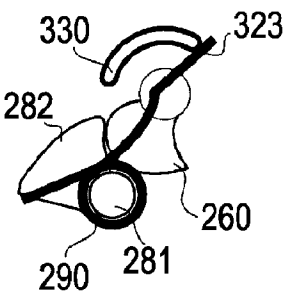
Figure 23G:
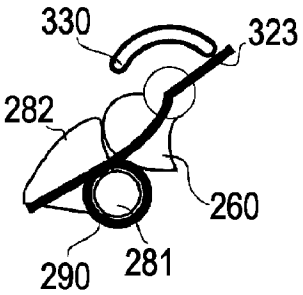
Figure 23H:
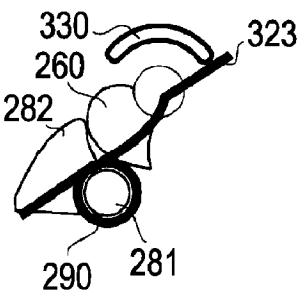
Figure 23I:
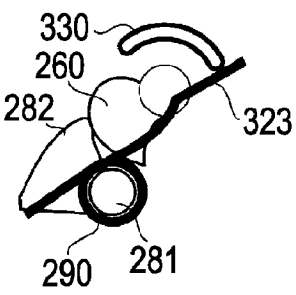
Figure 23J:
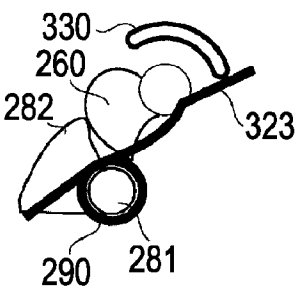

FIGS. 23A to 23J are diagrams illustrating the operation of the biasing force adjustment cam according to the third modified embodiment, showing the operation at phase angles ranging from 280 to 0 degrees (reset position). Specifically, FIGS. 23A to 23I are diagrams illustrating the operation at phase angles ranging from 280 to 360 degrees at intervals of 10 degrees. FIG. 23J is a diagram illustrating the operation when it returns back to the reset position. Here, the reset position is substantially the same as a phase angle of 360 degrees.

As shown in FIGS. 22A to 22O and FIGS. 23A to 23J, a biasing force adjustment cam 330 according to the third modified embodiment includes an arch portion 331, a first end portion 332, and a second end portion 333. The second arm portion 334 of the torsion coil spring 290 has a curved shape so that it can make linear contact with the outer circumference of the arch portion 331.

Other components or elements are the same as those of the embodiment described above and will be denoted by the same reference numerals, and therefore, descriptions thereof will be omitted.

When the feed motor 104 rotates in the forward direction, the biasing force adjustment cam 330 is pivoted in the clockwise direction in the drawings. Then, the biasing force adjustment cam 330 displaces the second arm portion 334 in the clockwise direction about the lever shaft 281. As shown in FIG. 22F, when the cam position is at a phase angle of 50 degrees, the hopper-up operation is carried out. Thereafter, the biasing force is increased by the biasing force adjustment cam 330 until the cam position is reached to a phase angle of 70 degrees.

The biasing force is decreased by the biasing force adjustment cam 330 when the cam position is at phase angles ranging from 230 to 290 degrees. When the cam position is at a phase angle of 280 degrees, the hopper-down operation is carried out.

The biasing force adjustment cam 330 is adapted to be pivoted in synchronism with the feed roller 230. Therefore, the feeding operation of the sheet P and the operation of the hopper 101 are carried out in the same manner as the embodiment described above.

The biasing force adjustment means according to the third modified embodiment includes the biasing force adjustment cam 330 as the cam portion. The biasing means includes the torsion coil spring 290. The hopper 101 is biased via the hopper lever 280 against the first arm portion 291, which is one end of the torsion coil spring 290. The second arm portion 334, which is the other end of the torsion coil spring 290, engages with the biasing force adjustment cam 330.

Modified Embodiment 4

Figure 24A:
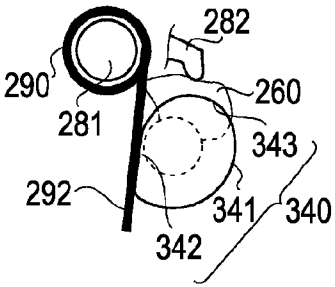
FIGS. 24A to 24O are diagrams illustrating the operation of a biasing force adjustment cam according to a fourth modified embodiment (at phase angles ranging from 0 to 270 degrees).
Figure 24B:
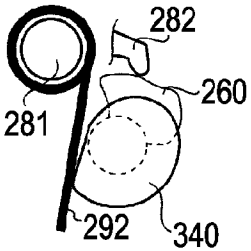
Figure 24C:
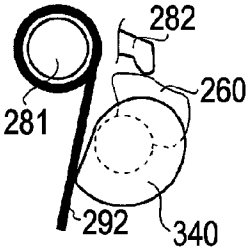
Figure 24D:
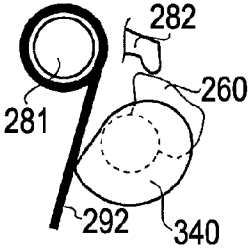
Figure 24E:
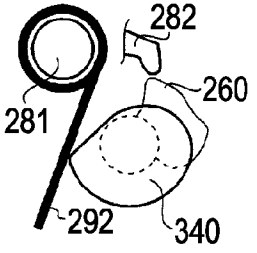
Figure 24F:
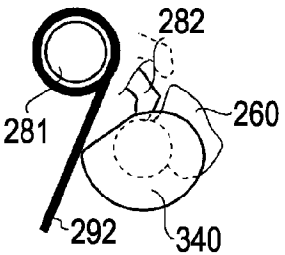
Figure 24G:
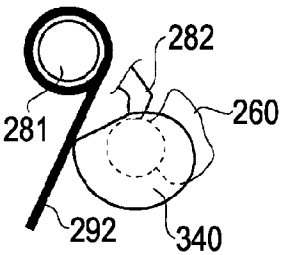
Figure 24H:
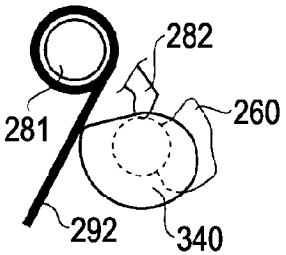
Figure 24I:
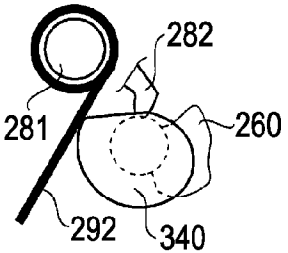
Figure 24J:
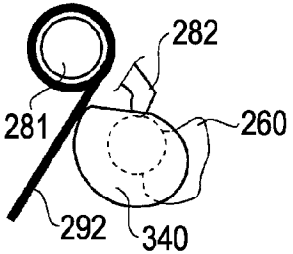
Figure 24K:
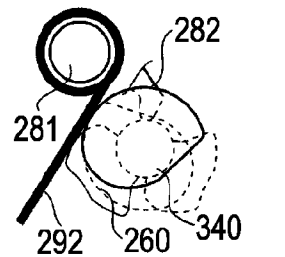
Figure 24L:
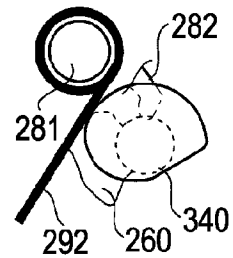
Figure 24M:
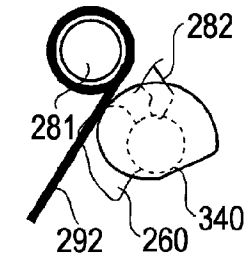
Figure 24N:
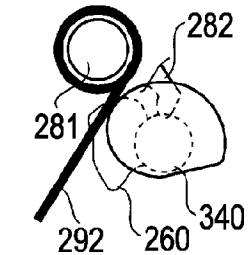
Figure 24O:
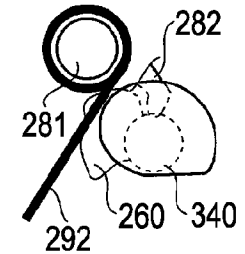

FIGS. 24A to 24O are diagrams illustrating the operation of a biasing force adjustment cam according to a fourth modified embodiment, showing the operation at phase angles ranging from 0 to 270 degrees. Specifically, FIGS. 24A to 24J are diagrams illustrating the operation at phase angles ranging from 0 (reset position) to 90 degrees at intervals of 10 degrees. FIG. 24K is a diagram illustrating the operation at phase angles ranging from 100 to 230 degrees. FIGS. 24L to 24O are diagrams illustrating the operation at phase angles ranging from 240 to 270 degrees at intervals of 10 degrees.

Figure 25A:
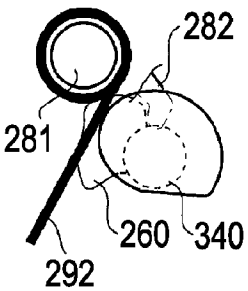
FIGS. 25A to 25J are diagrams illustrating the operation of the biasing force adjustment cam according to the fourth modified embodiment (at phase angles ranging from 280 to 360 degrees).
Figure 25B:
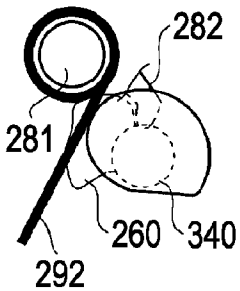
Figure 25C:
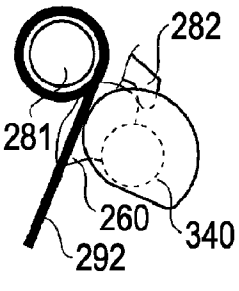
Figure 25D:
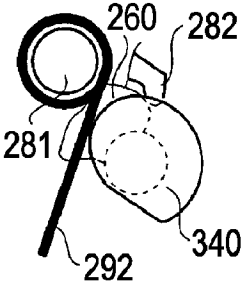
Figure 25E:
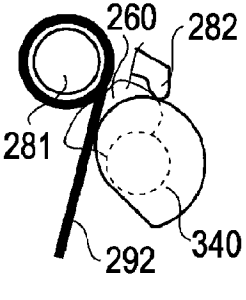
Figure 25F:
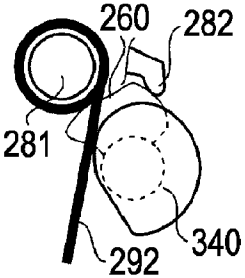
Figure 25G:
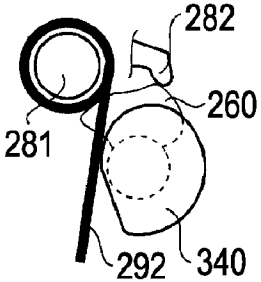
Figure 25H:
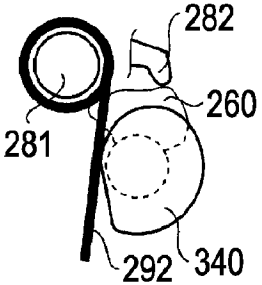
Figure 25I:
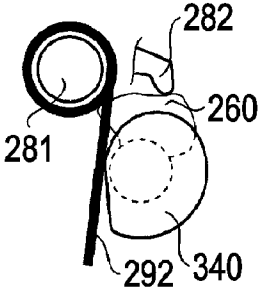
Figure 25J:
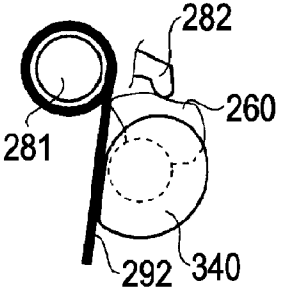
Figure 26:
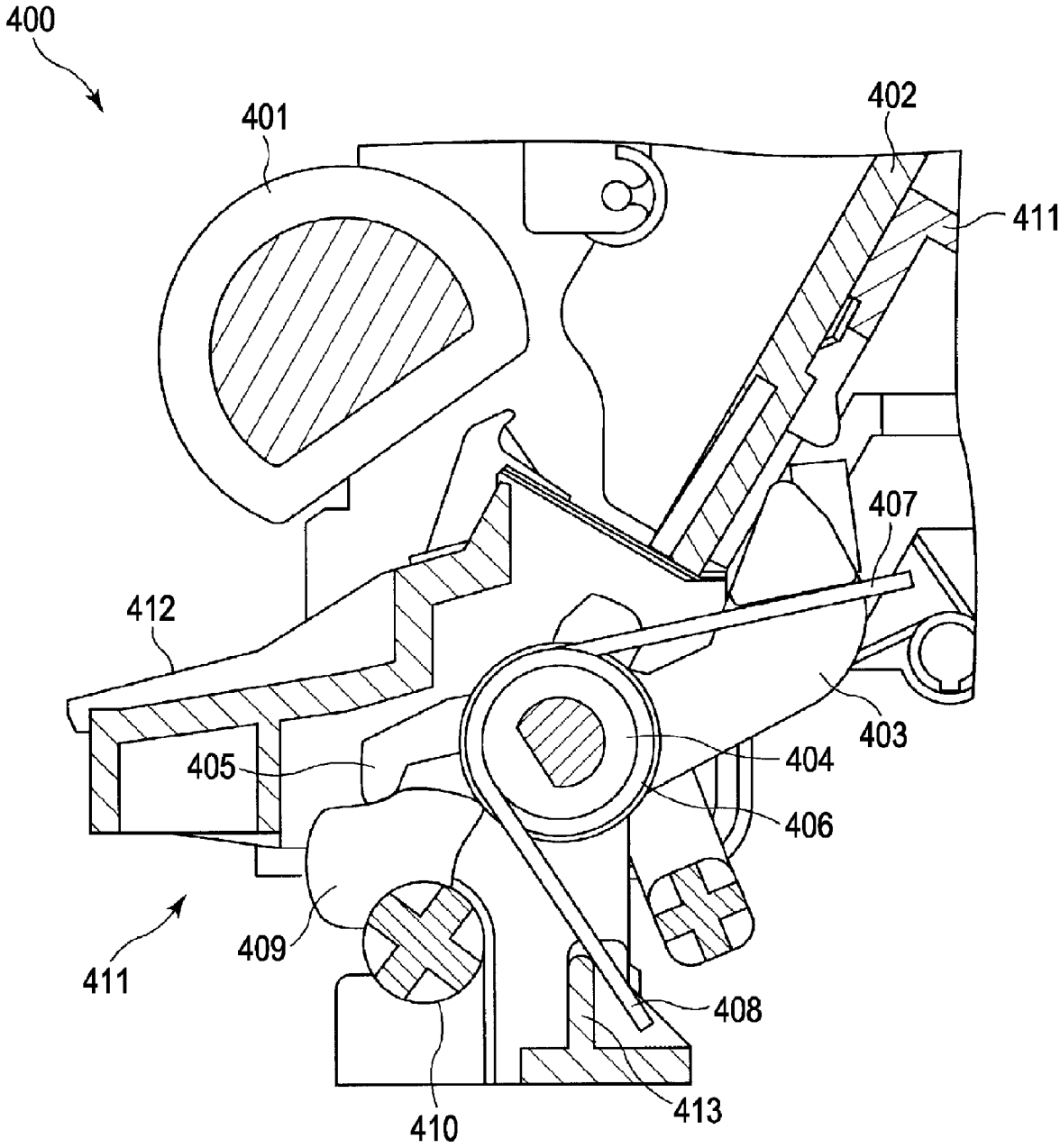
FIG. 26 is a side sectional view illustrating an outline of a feeding device according to the related art.

FIGS. 25A to 25J are diagrams illustrating the operation of the biasing force adjustment cam according to the fourth modified embodiment, showing the operation at phase angles ranging from 280 to 0 degrees (reset position). Specifically, FIGS. 25A to 25I are diagrams illustrating the operation at phase angles ranging from 280 to 360 degrees at intervals of 10 degrees. FIG. 25J is a diagram illustrating the operation when it returns back to the reset position. Here, the reset position is substantially the same as a phase angle of 360 degrees.

As shown in FIGS. 24A to 24O and FIGS. 25A to 25J, a biasing force adjustment cam 340 according to the fourth modified embodiment includes an arch portion 341, a flat portion 342, and a diameter changing portion 343.

Other components or elements are the same as those of the embodiment described above and will be denoted by the same reference numerals, and therefore, descriptions thereof will be omitted.

When the feed motor 104 rotates in the forward direction, the biasing force adjustment cam 340 is pivoted in the clockwise direction in the drawings. Then, the biasing force adjustment cam 340 displaces the second arm portion 292 in the clockwise direction about the lever shaft 281. As shown in FIG. 24F, when the cam position is at a phase angle of 50 degrees, the hopper-up operation is carried out. Thereafter, the biasing force is increased by the biasing force adjustment cam 340 until the cam position is reached to a phase angle of 70 degrees.

The biasing force is decreased by the biasing force adjustment cam 340 when the cam position is at phase angles ranging from 230 to 290 degrees. When the cam position is at a phase angle of 280 degrees, the hopper-down operation is carried out.

The biasing force adjustment cam 340 is adapted to be pivoted in synchronism with the feed roller 230. Therefore, the feeding operation of the sheet P and the operation of the hopper 101 are carried out in the same manner as the embodiment described above.

The biasing force adjustment means according to the fourth modified embodiment includes the biasing force adjustment cam 340 as the cam portion. The biasing means includes the torsion coil spring 290. The hopper 101 is biased via the hopper lever 280 against the first arm portion 291, which is one end of the torsion coil spring 290. The second arm portion 292, which is the other end of the torsion coil spring 290, engages with the biasing force adjustment cam 340.

In the embodiments described above, a plurality of the torsion coil springs may be provided and a plurality of biasing force adjustment cams may be provided so as to correspond to the torsion coil springs. By doing this, it is possible to adjust the biasing force in a more precise manner, which might be difficult for a single biasing force adjustment cam to realize.

In the embodiments described above, the hopper is moved toward and away from the feed roller; however, the feed roller may be moved toward and away from the hopper.

Moreover, in the embodiments described above, although the torsion coil spring is used as the biasing means, the invention is not limited to this and a coil spring, a plate spring, and the like may be used.

Although the exemplary embodiments of the invention have been described with reference to the accompanying drawings, it should be understood that the invention is not limited to such embodiments. Various shapes or combinations of respective constituent elements illustrated in the above-described embodiments are merely examples, and various changes may be made depending on design requirements or the like without departing from the spirit or scope of the invention.

The entire disclosure of Japanese Patent Application No. 2007-184430, filed Jul. 13, 2007 is expressly incorporated by reference herein.

What is claimed is:

1. A feeding device, comprising:

a stacking portion on which a plurality of recording media are stacked;

a feed roller that feeds the recording medium stacked on the stacking portion;

biasing means for applying biasing force to either the stacking portion or the feed roller to thereby decrease the distance between the stacking portion and the feed roller; and a biasing force adjustment means for adjusting the magnitude of the biasing force of the biasing means so as to decrease the magnitude of the biasing force when the distance between the stacking portion and the feed roller is increased and so as to increase the magnitude of the biasing force when the distance between the stacking portion and the feed roller is decreased.

2. The feeding device according to claim 1, wherein the biasing force adjustment means has a cam portion, wherein the biasing means has a torsion coil spring, wherein either the stacking portion or the feed roller is biased against one end of the torsion coil spring, and wherein the other end of the torsion coil spring engages with the cam portion.

3. The feeding device according to claim 1, further comprising displacing means for increasing the distance, wherein the biasing force adjustment means starts decreasing the biasing force before the distance is increased.

4. The feeding device according to claim 1, further comprising displacing means for increasing the distance, wherein the biasing force adjustment means adjusts the biasing force to the minimum value when the distance is increased by the displacing means.

5. The feeding device according to claim 1, further comprising a separation portion capable of separating overlapped recording media which are fed on the downstream side in a feeding direction of the feed roller, wherein the biasing force adjustment means increases the biasing force after the distance is decreased and until a leading end of a recording medium being fed passes through the separation portion.

6. The feeding device according to claim 5, further comprising a transport roller pair that transports the recording medium fed on the downstream side in the feeding direction of the separation portion toward the downstream side, wherein the biasing force adjustment means decreases the biasing force after the leading end of the recording medium being fed is passed through the separation portion and immediately before the leading end reaches the transport roller pair.

7. The feeding device according to claim 6, wherein the biasing force adjustment means increases the biasing force after the leading end of the recording medium being fed is reached to the transport roller pair and until a skew removing operation is completed.

8. A recording apparatus, comprising:

a feeding unit that feeds a plurality of recording media stored in stack; and a recording unit that records data or images on the recording medium fed from the feeding unit by means of a recording head, wherein the feeding unit includes the feeding device according to claim 1.

9. A feeding method, comprising:

biasing either a stacking portion on which a plurality of recording media are stacked or a feed roller that feeds the recording medium stacked on the stacking portion against one end of a torsion coil spring to thereby decreasing the distance between the stacking portion and the feed roller and increase the magnitude of the biasing force when the distance between the stacking portion and the feed roller is decreased; and displacing the other end of the torsion coil spring to thereby feed the recording medium.

* * * * *